US011441094B2

(12) United States Patent
Aritake et al.

(10) Patent No.: US 11,441,094 B2
(45) Date of Patent: Sep. 13, 2022

(54) REJUVENATION AND/OR EXTENSION OF THE LIFETIME OF FRICTIONAL PERFORMANCE IN TRANSMISSION FLUIDS

(71) Applicants: JATCO LTD, Fuji (JP); INFINEUM USA L.P., Linden, NJ (US)

(72) Inventors: Takashi Aritake, Shizuoka (JP); Gou Katou, Shizuoka (JP); Hahn Soo Kim, Basking Ridge, NJ (US); Thomas Lin, Linden, NJ (US); Makoto Maeda, Shizuoka (JP); Yasuhiro Mogi, Shizuoka (JP); Hiroshi Morisato, Tokyo (JP); Hirokazu Saito, Tokyo (JP)

(73) Assignees: JATCO LTD, Fuji (JP); INFINEUM INTERNATIONAL LIMITED, Abingdon (GB)

( * ) Notice: Subject to any disclaimer, the term of this patent is extended or adjusted under 35 U.S.C. 154(b) by 0 days.

(21) Appl. No.: 17/062,456

(22) Filed: Oct. 2, 2020

(65) Prior Publication Data

US 2022/0106537 A1 Apr. 7, 2022

(51) Int. Cl.
*C10M 125/24* (2006.01)
*C10M 133/44* (2006.01)
(Continued)

(52) U.S. Cl.
CPC ..... *C10M 125/24* (2013.01); *C10M 133/44* (2013.01); *C10M 135/30* (2013.01);
(Continued)

(58) Field of Classification Search
CPC ..... C10M 2207/028; C10M 2227/061; C10M 2215/223; C10M 2215/28; C10M 2215/08;
(Continued)

(56) References Cited

U.S. PATENT DOCUMENTS 5,840,663 A * 11/1998 Nibert ..... C10M 141/10 508/279
6,482,777 B2 11/2002 Cain
(Continued)

FOREIGN PATENT DOCUMENTS

| | | | |
|---|---|---|---|
| JP | 2020041005 | A | 3/2020 |
| WO | 2006106025 | A1 | 10/2006 |
| WO | 2008115726 | A3 | 11/2008 |

*Primary Examiner* — Vishal V Vasisth

(74) *Attorney, Agent, or Firm* — Loza & Loza, LLP; Julio Loza

(57) ABSTRACT

A booster additive concentrate may advantageously contain: (a) an anti-wear mixture of two or more phosphite/phosphate compounds and one or more ether/thioether compounds; (b) an ashless dispersant; (c) a calcium-containing detergent, such as an overbased calcium phenate; (d) ≥2 friction modifiers, at least one of which comprises a polyalkylene polyamine succinimide derivative; (e) optionally a corrosion inhibitor; and (f) a lubricating oil basestock. Based on these additive components, the booster additive concentrate may exhibit specific contents of B/Ca/P and may contain minimal or substantially no additional antioxidants. Lubricant compositions can be made from the booster additive concentrates and a fresh/used lubricant oil composition "diluent," which can rejuvenate the diluent. Such lubricant compositions can have advantageous anti-shudder durability (ASD) lifetimes and other frictional properties. In particular, such concentrates/compositions can offer superior lubrication when used in vehicles with continuously variable transmissions (CVTs).

25 Claims, 15 Drawing Sheets

(51) Int. Cl.

| | |
|---|---|
| ***C10M 135/30*** | (2006.01) |
| ***C10M 137/04*** | (2006.01) |
| ***C10M 159/22*** | (2006.01) |
| *C10N 30/00* | (2006.01) |
| *C10N 40/04* | (2006.01) |
| *C10N 10/04* | (2006.01) |
| *C10N 10/06* | (2006.01) |
| *C10N 30/04* | (2006.01) |
| *C10N 30/12* | (2006.01) |

(52) U.S. Cl.
CPC ..... *C10M 137/04* (2013.01); *C10M 159/22* (2013.01); *C10N 2010/04* (2013.01); *C10N 2010/06* (2013.01); *C10N 2030/04* (2013.01); *C10N 2030/12* (2013.01); *C10N 2030/45* (2020.05); *C10N 2030/76* (2020.05); *C10N 2040/042* (2020.05)

(58) Field of Classification Search
CPC ..... C10M 2219/022; C10M 2219/082; C10M 2219/085; C10M 2223/041; C10M 2223/049; C10N 2040/04; C10N 2030/76
See application file for complete search history.

(56) References Cited

U.S. PATENT DOCUMENTS

2002/0151443 A1* 10/2002 Srinivasan ..... C10M 161/00 508/273
2019/0177647 A1* 6/2019 Umamori ..... C10M 137/105

* cited by examiner

REJUVENATION AND/OR EXTENSION OF THE LIFETIME OF FRICTIONAL PERFORMANCE IN TRANSMISSION FLUIDS

FIELD

This disclosure relates to methods, compositions, and additive concentrates for boosting, rejuvenating, and/or extending the lifetime of frictional properties, particularly of anti-shudder durability properties, of transmission fluids, particularly of continuously variable transmission fluids.

BACKGROUND

Starting in the mid-1990's continuously variable transmissions (CVTs) went into wide usage in automobiles, particular passenger cars and sport utility vehicles. These transmissions were significantly different from the stepped automatic transmissions that were the choice for equipping vehicles with transmissions that did not require manual shifting of gears. Continuously variable transmissions were remarkable in their ability to improve the fuel economy of the vehicle in which it was deployed. Unlike a stepped automatic transmission, which had a discrete number of gear ratios, e.g. 3, 4 or 5, CVTs used a specialized belt drive system which was capable of an essentially infinite number of ratios between its upper and lower reduction ratios. This essentially infinite number of reduction ratios allowed the engine to be operated at its peak efficiency (rpm) the majority of the time the vehicle was moving, varying ground speed by varying the reduction ratio in the transmission. These features, ease of operation, and increase in vehicle efficiency have made this transmission very popular.

The key to the operation of CVTs is the variator system used to achieve the wide range of reduction ratios. The variator is composed of two pulleys connected by either a belt or a chain. The pulleys are hydraulically controlled such that the distance between the two halves of the pulley (sheave) can be varied. As the distance between the pulley halves increases the belt or chain moves closer to the center of the pulley, thereby reducing the drive radius. Concurrently the distance between the other pulley halves is decreased, thereby keeping the length of the belt constant and increasing the effective radius of the pulley. High reduction ratios, such as 5:1, can be achieved by driving the variator with a small radius; while low ratios, such as 0.5:1, can be achieved by driving the variator with a large radius.

The belts or chains used in these variators are typically made of metal, such as steel. The chains are pulled to transmit the force (energy) through the variator; the belts, which are of a complex design, are pushed to transmit the force. Crucial to the success of the variator is a lubricant which can deliver a high coefficient of friction between the pulley face and the contacting portion of the chain or belt. These specialized lubricants are termed continuously variable transmission fluids (CVTFs).

To further increase the efficiency of the CVT, advanced technology may be used to couple the transmission to the engine. Two types of couplings are routinely used for this. One is a torque converter with a continuously slipping, or "lock up," clutch. In this device, the losses normally incurred by use of a torque converter are significantly reduced by including a clutch device that can reduce the relative speed between the driving and driven elements, thereby reducing or eliminating this energy being turned in to heat. Reducing the thermal losses in the torque converter increases its efficiency. The second device is a "wet start clutch." This device is simply an oil lubricated clutch composed of alternating (typically also metal/steel) plates and friction discs, which device is closed to accelerate the vehicle. Once the clutch is closed there is little or no energy loss, thereby making it more efficient than a torque converter.

These two components of CVTs require very specific lubricants to operate successfully and have the desired problem-free life. The variator needs a lubricant that can provide a high coefficient of friction between the pulley surfaces and the belt or chain. This is accomplished by including in the lubricant additive components that will interact or react together under high pressure and temperature, such as typically experienced between the pulley face and belt/chain, to form a high friction film. This film is often referred to as a "tribofilm." On the other hand, the torque converter clutch or wet start clutch needs a lubricant that can provide the proper relationship of friction coefficient to speed. For proper operation, the lubricant used in these devices needs to provide a positive friction gradient, i.e., the friction coefficient should increase with increasing sliding speed. This is often alternatively referred to as a positive $d\mu/dv$. If the friction gradient becomes negative the clutch device can experience erratic friction behavior, known as "shudder," which is a type of stick/slip phenomenon. Drivers may feel this as a vibration in the vehicle and generally do not tolerate it well. Positive friction coefficients may be established in these systems by precise choice of friction modifying additive components, friction modifiers. These chemicals may reduce the friction between sliding components. A properly friction modified fluid can deliver a positive friction gradient but can still deliver a high static coefficient of friction. Balancing these two critical performance requirements of CVTs requires rigorous formulation development done by expert formulators.

The lifetime of a CVTF can be determined by how long, e.g., how many kilometers, it takes before it can no longer deliver the required/desired performance. In the case of the variator, since to function properly the lubricant must deliver a solid high friction film to the pulley surface, additive components can be slowly consumed over the lifetime of the fluid. In service, these fluids typically show slow reduction in the concentration of additive components used to establish the tribofilm, noticeably calcium and phosphorus. In the case of the clutch devices, the organic friction modifiers used to accurately control the friction in the clutch may be slowly oxidized or thermally degraded to a point where a positive friction gradient can no longer be maintained. This performance can be monitored by assessing the friction gradient in an appropriate tester, e.g., a Low Velocity Friction Apparatus.

The present disclosure describes how a formulator may take advantage of the fact that only/mostly these performance-achieving additives have been depleted or degraded in the operation of the transmission. The base fluid used in the CVTF usually has not been damaged significantly performance-wise and may suitable for much longer service. And so, it has been found that, by simply replacing friction controlling additives for the variator and clutch, which represent a very small fraction of the volume of the CVTF, initial fluid performance can be rejuvenated or essentially restored. This can obviate the necessity for a complicated and expensive oil change.

SUMMARY

The present disclosure provides additive concentrates, fully formulated lubricant compositions, and methods for using same to rejuvenate fresh/used lubricating oil compositions.

A booster additive concentrate according to the present disclosure may advantageously contain: (a) an anti-wear mixture of two or more phosphite/phosphate compounds and one or more ether/thioether compounds; (b) an ashless dispersant that can represent at least 20 mass % of the booster additive concentrate; (c) a calcium-containing detergent, such as an overbased calcium phenate; (d) at least two friction modifiers, at least one of which comprises a polyethylene polyamine succinimide derivative; (e) optionally but preferably a corrosion inhibitor; and (f) a suspension-stabilizing amount of a lubricating oil basestock. Based on these additive components, the booster additive concentrate may exhibit: a boron content from 0.04 mass % to 0.75 mass %, a calcium content from 0.3 mass % to 1.5 mass %, and a phosphorus content from 0.3 mass % to 1.5 mass %, each based on the total mass of the additive concentrate.

A lubricant composition according to the present disclosure may comprise a diluted form of a booster additive concentrate according to the present disclosure. The diluent may be either a fresh (unused) fully formulated lubricating oil composition or a lubricating oil composition that has been used (the additive components of which may have at least partially degraded, due to operation of a vehicle transmission). Examples of such used lubricant compositions can include those that, when fresh and prior to use, comprised at least an anti-wear additive, an ashless dispersant, an overbased calcium detergent, a friction modifier, a corrosion inhibitor, at least two additional antioxidants, and a lubricating oil basestock.

A method for rejuvenating a fresh or used lubricating oil composition (if used, operated for at least 25,000 kilometers) according to the present disclosure may include forming a rejuvenated lubricating oil composition according to the present disclosure by admixing a booster additive concentrate according to present disclosure with the fresh/used lubricating oil composition; and lubricating the vehicle transmission with the rejuvenated lubricating oil composition according to the present disclosure to enable further operation, e.g., for at least an additional 30,000 kilometers (or a simulated lubrication running time equivalent thereto).

Additionally or alternatively to the disclosed methods are uses of the booster additive concentrates according to present disclosure, in combination with a fresh/used fully formulated lubricating oil composition, or uses of rejuvenated lubricating oil compositions according to the present disclosure, to rejuvenate lubricant properties at least partially lost during previous operation of a vehicle transmission, particularly rejuvenating one or more of anti-shudder durability, friction modification, dynamic-static friction balance, anti-wear, soot dispersion capability, detergency, suspension stability, and corrosion inhibition.

DETAILED DESCRIPTION

Figure 1:
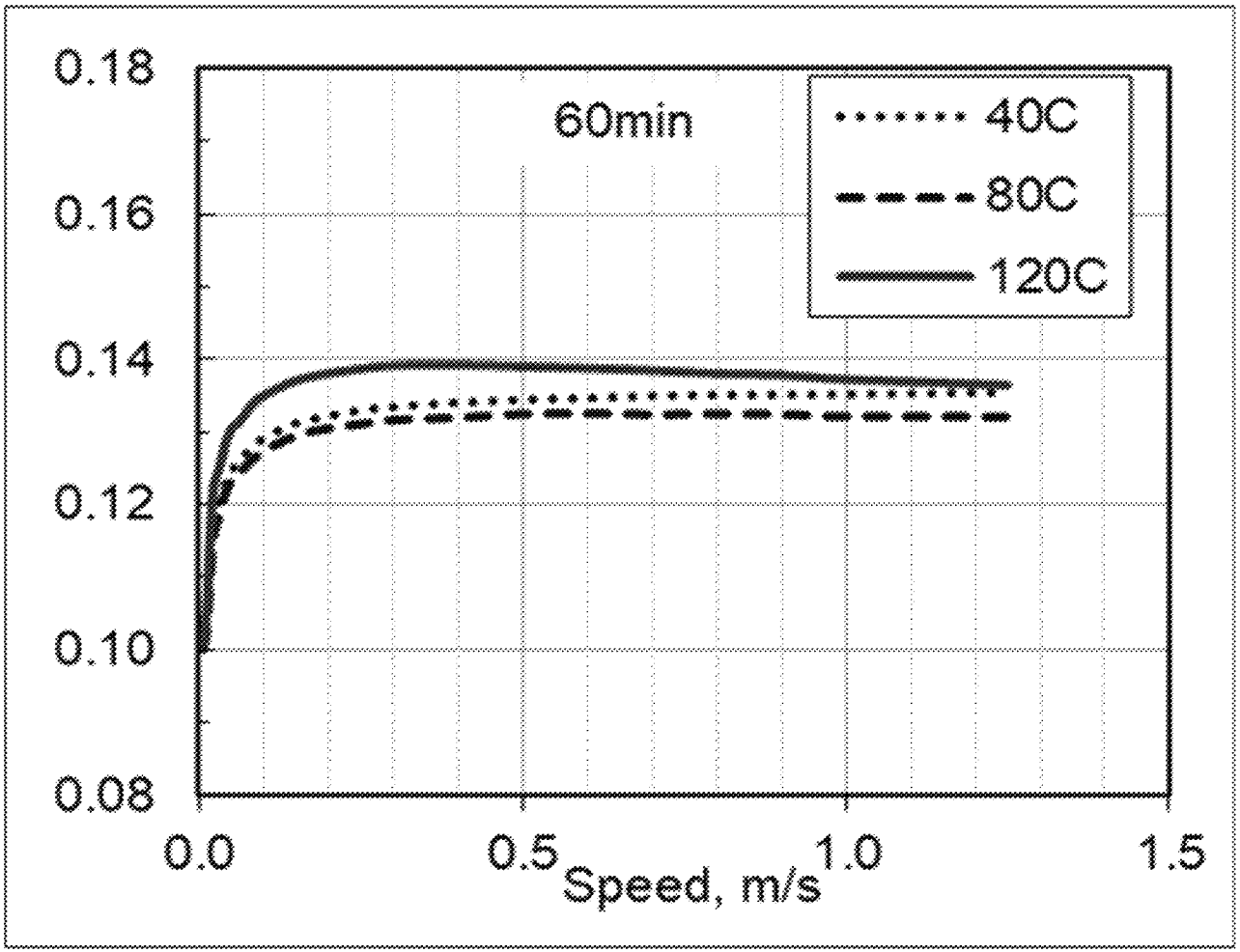
FIGS. 1-7 are graphs of the dynamic Mu-V curve characteristics (under constant pressure conditions), at ~40° C., ~80° C., and ~120° C., for a fresh lubricating oil composition (FIG. 1) and for various rejuvenated lubricating oil compositions made from used lubricating oil composition and booster additive package compositions of Comparative Examples 1 (FIG. 2), 2 (FIG. 3), 3 (FIG. 4), and 4 (FIG. 5), and of Examples 1 (FIG. 6) and 2 (FIG. 7).
Figure 2:
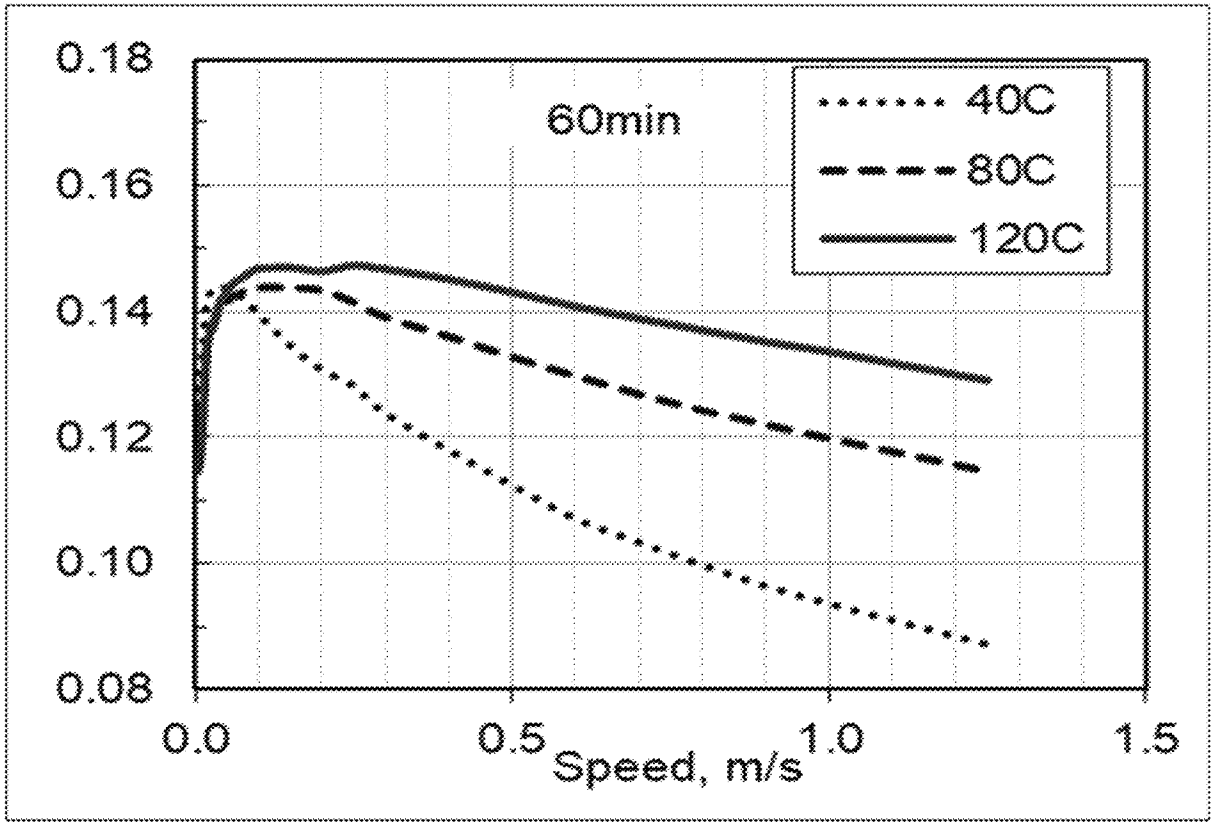
Figure 3:
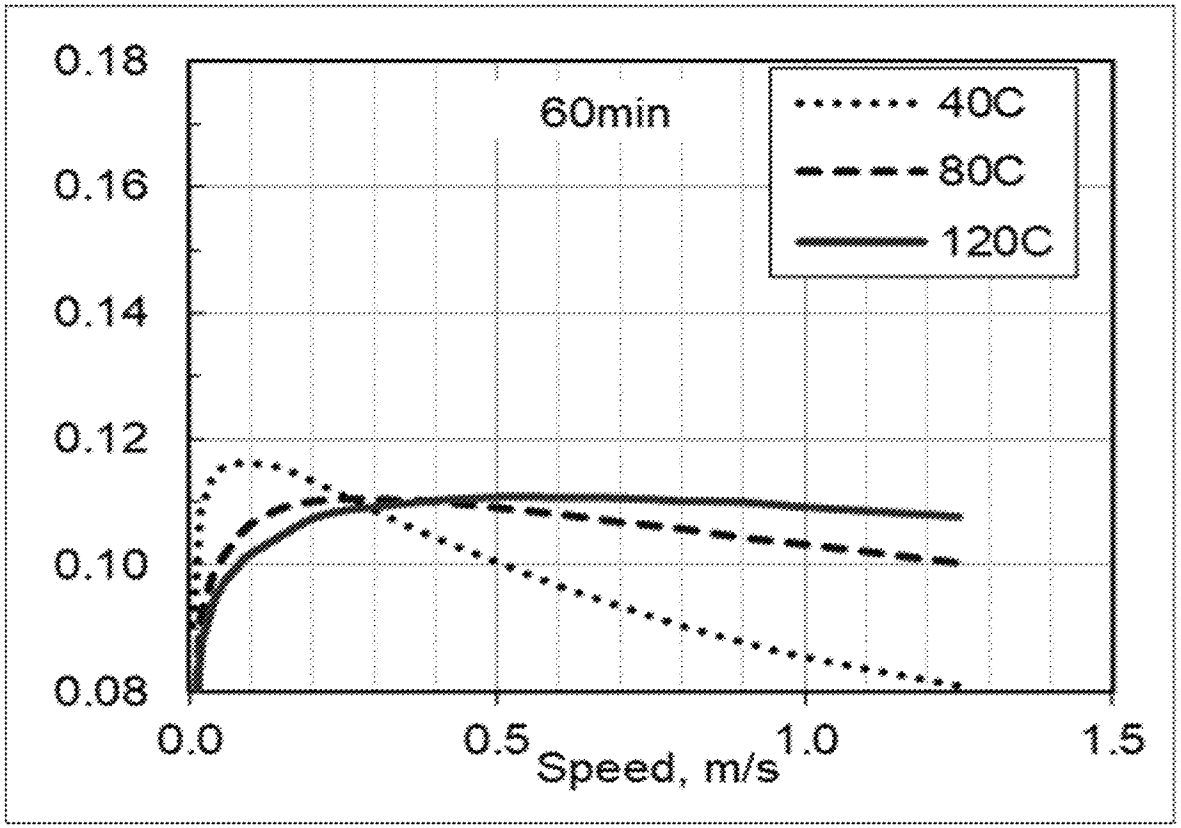
Figure 4:
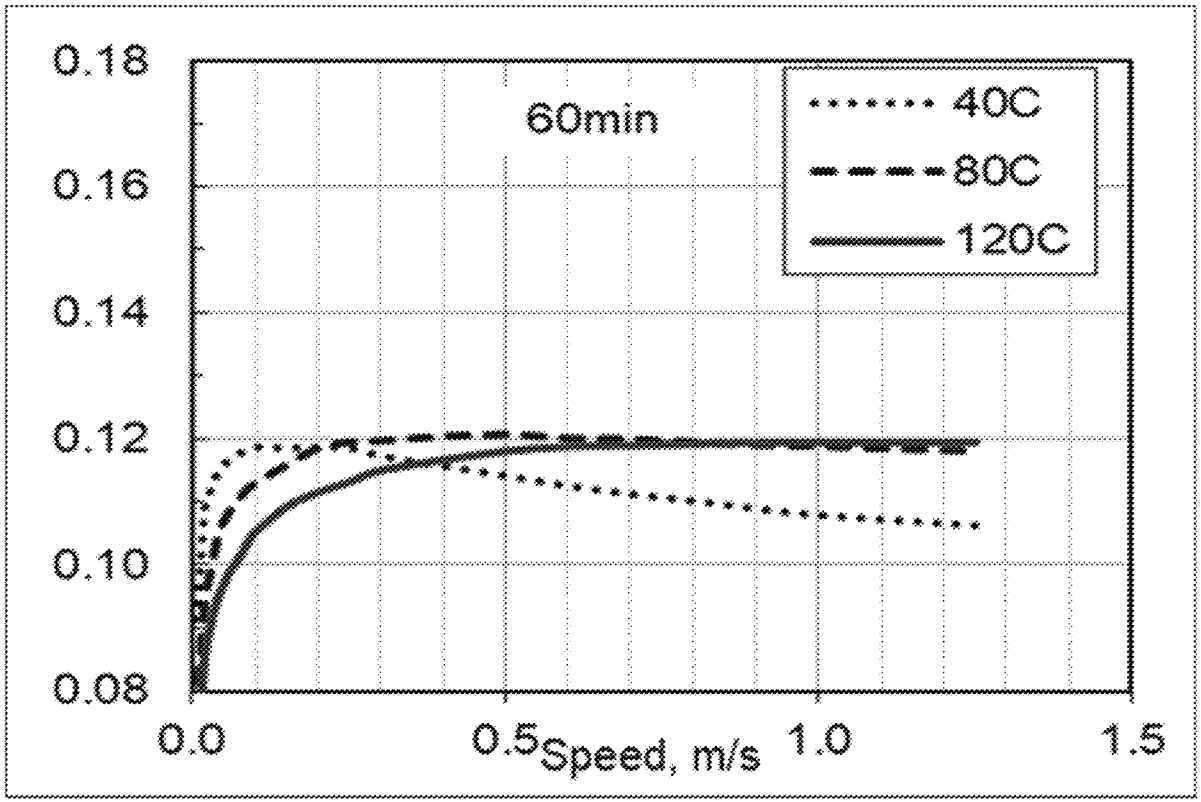
Figure 5:
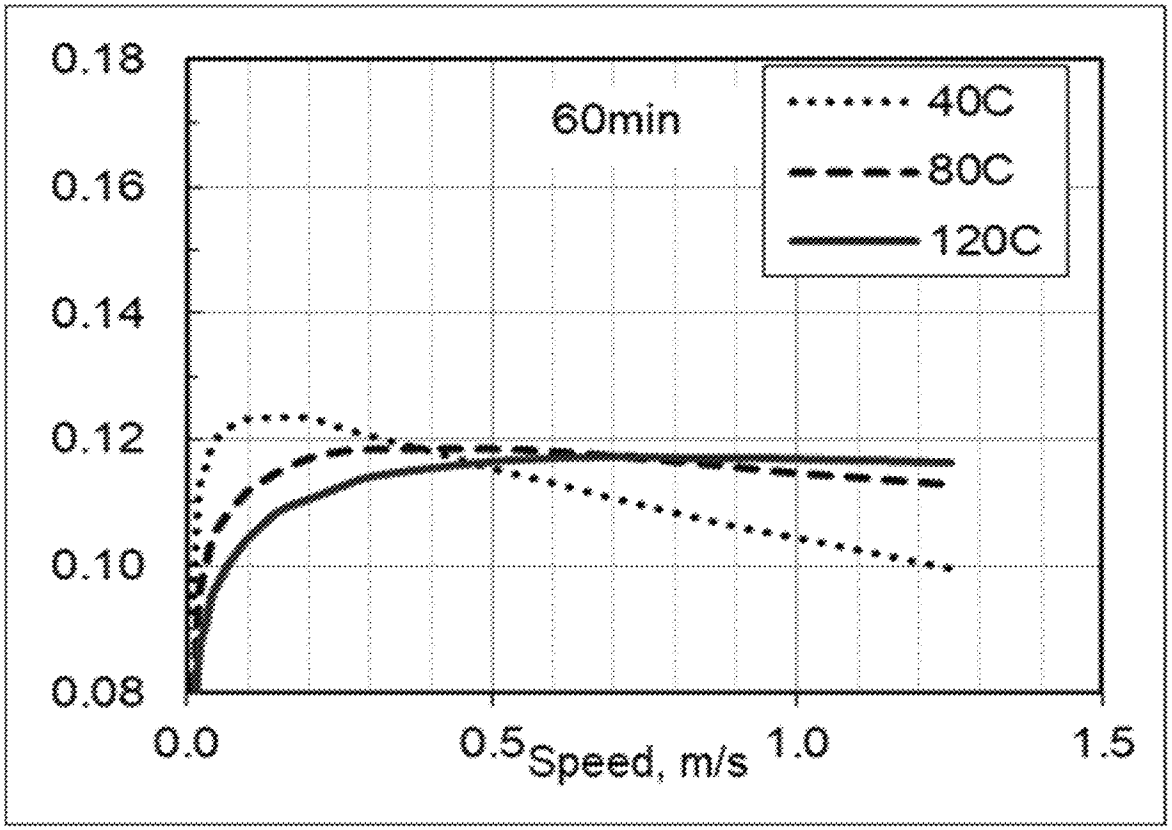
Figure 6:
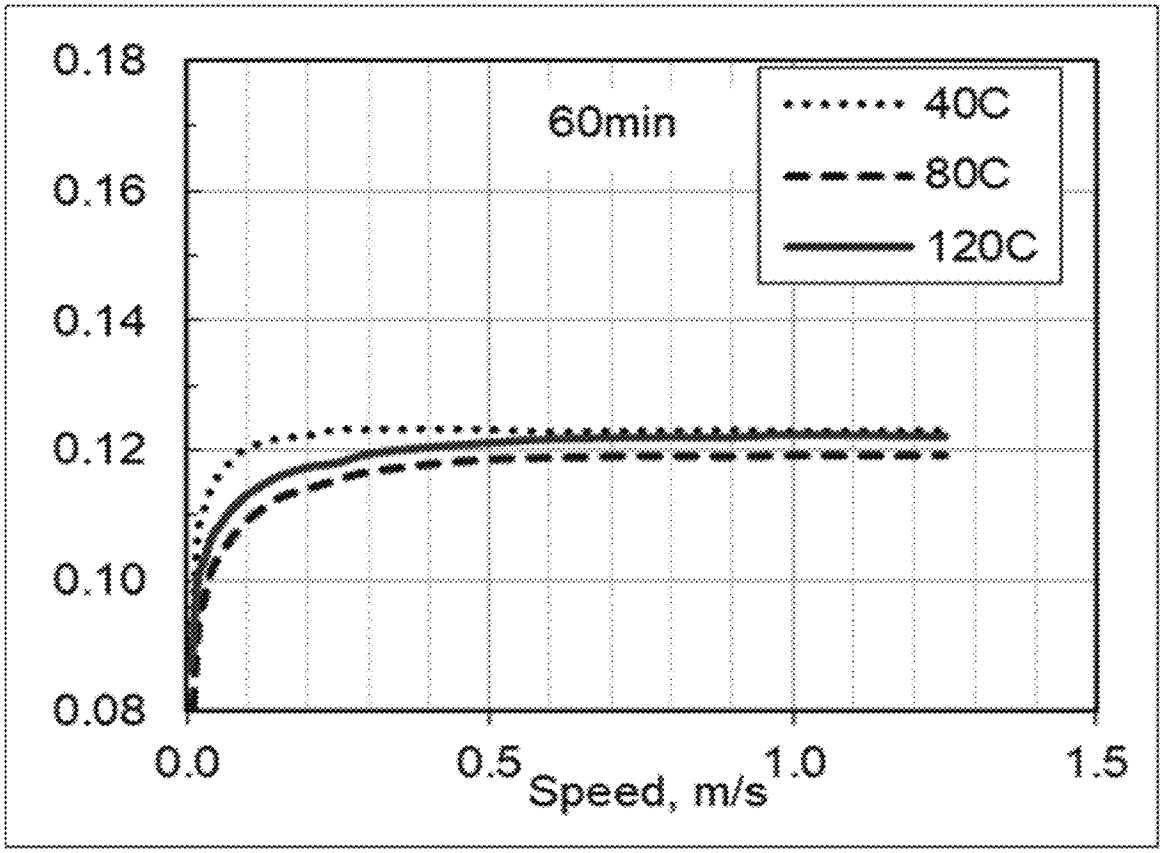

The present disclosure encompasses suspension-stable additive package compositions (concentrates) for lubricant fluids, suspension-stable booster additive package compositions (concentrates) for used (or new but otherwise fully formulated) lubricant fluids, and the lubricant fluid compositions containing the suspension-stable (booster) additive package concentrates admixed with (or as diluted by) lubricating oil basestocks. When the lubricant fluids are being used in the drivetrains of vehicles, such as in transmissions or crankcases, used lubricant fluids can represent either fluids that had actually been used to lubricate at least a portion of a vehicle drivetrain for at least 25,000 kilometers (e.g., for at least 30,000 kilometers, for at least 35,000 kilometers, for at least 50,000 kilometers, for at least 60,000 kilometers, or for at least 70,000 kilometers, and optionally for up to 100,000 kilometers or more or for up to 150,000 kilometers or more), or that had been exposed to accelerated conditions meant to simulate such lubrication/operational conditions (e.g., at more severe conditions but for shorter times, yet still correlating to an equivalent or higher vehicle drivetrain mileage).

In some embodiments, booster additive package compositions/concentrates to be admixed with new but otherwise fully formulated lubricating oil compositions may comprise less than a full complement of lubricant additive components, e.g., to allow for the fact that some functional additives may adequately perform their function over the entire useful life of the formulated lubricating oil composition, whereas other functional additives may be consumed, deactivated, decomposed, or otherwise ineffective to adequately perform their function typically toward the end of useful life of the formulated lubricating oil composition. As a result, in these embodiments, only certain additives need to be added to the booster composition/concentrate to supplement those functions where additives are rendered ineffective through extended use.

Additionally or alternatively, booster additive package compositions/concentrates to be admixed with either new (but fully formulated) or used lubricant fluids may comprise additives at relatively higher concentrations than in a fully formulated lubricating oil composition, at relatively lower concentrations, or at relatively similar concentrations, depending upon the particular application. For instance, lubricant used in more severe environments may indicate relatively higher concentrations, whereas tweaking additives to attain a uniformly long lifetime in the boosted lubricant fluid composition may indicate relatively lower or similar concentrations.

Although the disclosure specifies transmission fluid compositions and applications in vehicle transmissions, it is contemplated that these general principles may be used for booster additive package compositions/concentrates in other applications and for lubricating oil compositions containing such compositions/concentrates. Furthermore, although the term "rejuvenated" is used herein typically in reference to bringing characteristics of used lubricating oil compositions back up near their fresh (unused) values, it should be understood that "rejuvenated" may additionally or alternatively apply to fresh lubricating oil compositions in which certain characteristics can be enhanced without ever being diminished by use. It should also be understood that the combination of admixed additives may exist as-introduced into the concentrate or may be complexed, reacted, or in some other way altered; however, as described herein, the term "comprising" in reference to concentrates or diluted lubricating formulations/compositions is satisfied by admixing of the ingredients, regardless of any complexation, reaction, or other component modification post-admixing, during use, or in analysis.

Transmission fluid compositions according to the present disclosure typically refer to admixtures of a majority of lubricating oil composition and a minority of additive package concentrate (which itself typically has some lubricating oil basestock to maintain its suspension or solution stability in the majority lubricating oil composition). Transmission fluid booster additive package compositions according to the present disclosure, therefore, typically contain a much higher concentration of additive components and a much lower concentration of lubricating oil composition, but yet should contain enough lubricating oil composition to enable the additive components to be and to remain suspended (or dissolved) for reasonable time periods (e.g., such as at least several months and/or up to a year or two years or more; termed "suspension-stable" herein), without substantial dissolution, precipitation, and/or settling out of suspension. In addition or supplemental to lubricating oil basestock in such concentrates, dispersant additive concentrations may be adjusted so that the additive package concentrates (and the diluted transmission fluid compositions containing them) are and remain suspension-stable.

Lubricating Oils/Basestocks

The amount of lubricating oil basestock in transmission fluid booster additive package concentrates according to the present disclosure can typically be a minor amount (i.e., less than 50%, based on the weight of the concentrate), with each of the components of the concentrate typically also constituting a minor amount as well. For example, the transmission fluid booster additive package concentrate may comprise from 1.0% to below 50%, from 1.0% to 45%, from 1.0% to 40%, from 1.0% to 35%, from 1.0% to 30%, from 1.0% to 25%, from 1.0% to 20%, from 1.0% to 15%, from 1.0% to 10%, from 1.0% to 5.0%, from 3.0% to below 50%, from 3.0% to 45%, from 3.0% to 40%, from 3.0% to 35%, from 3.0% to 30%, from 3.0% to 25%, from 3.0% to 20%, from 3.0% to 15%, from 3.0% to 10%, from 3.0% to 5.0%, from 5.0% to below 50%, from 5.0% to 45%, from 5.0% to 40%, from 5.0% to 35%, from 5.0% to 30%, from 5.0% to 25%, from 5.0% to 20%, from 5.0% to 15%, from 5.0% to 10%, from 10% to below 50%, from 10% to 45%, from 10% to 40%, from 10% to 35%, from 10% to 30%, from 10% to 25%, from 10% to 20%, from 10% to 15%, from 15% to below 50%, from 15% to 45%, from 15% to 40%, from 15% to 35%, from 15% to 30%, from 15% to 25%, from 15% to 20%, from 20% to below 50%, from 20% to 45%, from 20% to 40%, from 20% to 35%, from 20% to 30%, from 20% to 25%, from 25% to below 50%, from 25% to 45%, from 25% to 40%, from 25% to 35%, from 25% to 30%, from 30% to below 50%, from 30% to 45%, from 30% to 40%, from 30% to 35%, from 35% to below 50%, from 35% to 45%, from 35% to 40%, from 40% to below 50%, from 40% to 45%, or from 45% to below 50%, of lubricating oil basestock, based on the weight of the concentrate, in particular from 5.0% to 40%, from 5.0% to 35%, from 15% to 40%, or from 15% to 35%. The remainder of the booster additive package concentrate may be comprised of functional additive component compositions, one, some, or each of which may contain up to 60 mass %, but more often from 5 mass % to below 50 mass % (if present) of a lubricating oil basestock as a diluent/suspension-stabilizing agent.

The amount of lubricating oil basestock in transmission fluid compositions according to the present disclosure can typically be a major amount (i.e., more than 50%, based on the weight of the composition), with the additive package collectively, and each of the functional/additive components of the additive package/concentrate individually, typically constituting a minor amount (i.e., less than 50%, based on the weight of the composition). For example, the transmission fluid composition may comprise from above 50% to 99%, from above 50% to 98%, from above 50% to 97%, from above 50% to 96%, from above 50% to 95%, from above 50% to 94%, from above 50% to 93%, from above 50% to 92%, from above 50% to 91%, from above 50% to 90%, from above 50% to 88%, from above 50% to 86%, from above 50% to 84%, from above 50% to 82%, from above 50% to 80%, from 60% to 99%, from 60% to 98%, from 60% to 97%, from 60% to 96%, from 60% to 95%, from 60% to 94%, from 60% to 93%, from 60% to 92%, from 60% to 91%, from 60% to 90%, from 60% to 88%, from 60% to 86%, from 60% to 84%, from 60% to 82%, from 60% to 80%, from 70% to 99%, from 70% to 98%, from 70% to 97%, from 70% to 96%, from 70% to 95%, from 70% to 94%, from 70% to 93%, from 70% to 92%, from 70% to 91%, from 70% to 90%, from 70% to 88%, from 70% to 86%, from 70% to 84%, from 70% to 82%, from 70% to 80%, from 75% to 99%, from 75% to 98%, from 75% to 97%, from 75% to 96%, from 75% to 95%, from 75% to 94%, from 75% to 93%, from 75% to 92%, from 75% to 91%, from 75% to 90%, from 75% to 88%, from 75% to 86%, from 75% to 84%, from 75% to 82%, from 75% to 80%, from 80% to 99%, from 80% to 98%, from 80% to 97%, from 80% to 96%, from 80% to 95%, from 80% to 94%, from 80% to 93%, from 80% to 92%, from 80% to 91%, from 80% to 90%, from 80% to 88%, from 80% to 86%, from 80% to 84%, from 85% to 99%, from 85% to 98%, from 85% to 97%, from 85% to 96%, from 60% to 95%, from 85% to 94%, from 85% to 93%, from 85% to 92%, from 85% to 91%, from 85% to 90%, or from 85% to 88%, of lubricating oil basestock, based on the weight of the composition, in particular from 60% to 99%, from 70 to 98%, from 75 to 97%, or from 80 to 96%, based on the weight of the composition. Additionally or alternatively, the transmission fluid composition may comprise an admixture of a booster additive package concentrate and either a used transmission lubricant fluid or a new (but fully formulated) transmission lubricant fluid in a mass ratio of booster concentrate to used/new transmission lubricant fluid from 1:99 to 1:4, e.g., from 1:99 to 1:5, from 1:99 to 1:7, from 1:99 to 1:9, from 1:99 to 1:11, from 1:99 to 1:15, from 1:99 to 1:19, from 1:99 to 1:24, from 1:99 to 1:32, from 1:99 to 1:49, from 1:49 to 1:4, from 1:49 to 1:5, from 1:49 to 1:7, from 1:49 to 1:9, from 1:49 to 1:11, from 1:49 to 1:15, from 1:49 to 1:19, from 1:49 to 1:24, from 1:49 to 1:32, from 1:32 to 1:4, from 1:32 to 1:5, from 1:32 to 1:7, from 1:32 to 1:9, from 1:32 to 1:11, from 1:32 to 1:15, from 1:32 to 1:19, from 1:32 to 1:24, from 1:24 to 1:4, from 1:24 to 1:5, from 1:24 to 1:7, from 1:24 to 1:9, from 1:24 to 1:11, from 1:24 to 1:15, from 1:24 to 1:19, from 1:19 to 1:4, from 1:19 to 1:5, from 1:19 to 1:7, from 1:19 to 1:9, from 1:19 to 1:11, from 1:19 to 1:15, from 1:15 to 1:4, from 1:15 to 1:5, from 1:15 to 1:7, from 1:15 to 1:9, from 1:15 to 1:11, from 1:11 to 1:4, from 1:11 to 1:5, from 1:11 to 1:7, from 1:11 to 1:9, from 1:9 to 1:4, from 1:9 to 1:5, from 1:9 to 1:7, from 1:7 to 1:4, or from 1:7 to 1:5, in particular from 1:49 to 1:7, from 1:24 to 1:7, from 1:32 to 1:8, or from 1:24 to 1:9.

The lubricating oil basestock may be any suitable lubricating oil basestock known in the art. Both natural and synthetic lubricating oil basestocks may be suitable. Natural lubricating oils may include animal oils, vegetable oils (e.g., castor oil and lard oil), petroleum oils, mineral oils, oils derived from coal or shale, and combinations thereof. One particular natural lubricating oil includes or is mineral oil.

Suitable mineral oils may include all common mineral oil basestocks, including oils that are naphthenic or paraffinic in chemical structure. Suitable oils may be refined by conventional methodology using acid, alkali, and clay, or other agents such as aluminum chloride, or they may be extracted oils produced, for example, by solvent extraction with solvents such as phenol, sulfur dioxide, furfural, dichlorodiethyl ether, etc., or combinations thereof. They may be hydrotreated or hydrofined, dewaxed by chilling or catalytic dewaxing processes, hydrocracked, or some combination thereof. Suitable mineral oils may be produced from natural crude sources or may be composed of isomerized wax materials, or residues of other refining processes.

Synthetic lubricating oils may include hydrocarbon oils and halo-substituted hydrocarbon oils such as oligomerized, polymerized, and interpolymerized olefins (e.g., polybutylenes, polypropylenes, propylene, isobutylene copolymers, chlorinated polylactenes, poly(1-hexenes), poly(1-octenes), poly-(1-decenes), etc., and mixtures thereof); alkylbenzenes (e.g., dodecyl-benzenes, tetradecylbenzenes, dinonyl-benzenes, di(2-ethylhexyl)benzene, etc.); polyphenyls (e.g., biphenyls, terphenyls, alkylated polyphenyls, etc.); alkylated diphenyl ethers, alkylated diphenyl sulfides, as well as their derivatives, analogs, and homologs thereof, and the like; and combinations and/or reaction products thereof.

In some embodiments, oils from this class of synthetic oils may comprise or be polyalphaolefins (PAO), including hydrogenated oligomers of an alpha-olefin, particularly oligomers of 1-decene, such as those produced by free radical processes, Ziegler catalysis, or cationic catalysis. They may, for example, be oligomers of branched or straight chain alpha-olefins having from 2 to 16 carbon atoms, specific non-limiting examples including polypropenes, polyisobutenes, poly-1-butenes, poly-1-hexenes, poly-1-octenes, poly-1-decene, poly-1-dodecene, and mixtures and/or interpolymers/copolymers thereof.

Synthetic lubricating oils may additionally or alternatively include alkylene oxide polymers, interpolymers, copolymers, and derivatives thereof, in which any (most) terminal hydroxyl groups have been modified by esterification, etherification, etc. This class of synthetic oils may be exemplified by: polyoxyalkylene polymers prepared by polymerization of ethylene oxide or propylene oxide; the alkyl and aryl ethers of these polyoxyalkylene polymers (e.g., methyl-polyisopropylene glycol ether having an average Mn of ~1000 Daltons, diphenyl ether of polypropylene glycol having an average Mn from about 1000 to about 1500 Daltons); and mono- and poly-carboxylic esters thereof (e.g., acetic acid ester(s), mixed $C_3$-$C_8$ fatty acid esters, $C_{12}$ oxo acid diester(s) of tetraethylene glycol, or the like, or combinations thereof).

Another suitable class of synthetic lubricating oils may comprise the esters of dicarboxylic acids (e.g., phthalic acid, succinic acid, alkyl succinic acids and alkenyl succinic acids, maleic acid, azelaic acid, suberic acid, sebacic acid, fumaric acid, adipic acid, linoleic acid dimer, malonic acid, alkylmalonic acids, alkenyl malonic acids, etc.) with a variety of alcohols (e.g., butyl alcohol, hexyl alcohol, dodecyl alcohol, 2-ethylhexyl alcohol, ethylene glycol, diethylene glycol monoethers, propylene glycol, etc.). Specific examples of these esters include dibutyl adipate, di(2-ethylhexyl) sebacate, di-n-hexyl fumarate, dioctyl sebacate, diisooctyl azelate, diisodecyl azelate, dioctyl phthalate, didecyl phthalate, dieicosyl sebacate, the 2-ethylhexyl diester of linoleic acid dimer, a complex ester formed by reacting one mole of sebacic acid with two moles of tetraethylene glycol and two moles of 2-ethyl-hexanoic acid, and the like, and combinations thereof. A preferred type of oil from this class of synthetic oils may include adipates of $C_4$ to $C_{12}$ alcohols.

Esters useful as synthetic lubricating oils may additionally or alternatively include those made from $C_5$-$C_{12}$ monocarboxylic acids, polyols, and/or polyol ethers, e.g., such as neopentyl glycol, trimethylolpropane pentaerythritol, dipentaerythritol, tripentaerythritol, and the like, as well as combinations thereof.

The lubricating oils may be derived from unrefined oils, refined oils, re-refined oils, or mixtures thereof. Unrefined oils are obtained directly from a natural source or synthetic source (e.g., coal, shale, or tar sands bitumen) without further purification or treatment. Examples of unrefined oils may include a shale oil obtained directly from a retorting operation, a petroleum oil obtained directly from distillation, or an ester oil obtained directly from an esterification process, each or a combination of which may then be used without further treatment. Refined oils are similar to the unrefined oils, except that refined oils have typically been treated in one or more purification steps to change chemical structure and/or to improve one or more properties. Suitable purification techniques may include distillation, hydrotreating, dewaxing, solvent extraction, acid or base extraction, filtration, and percolation, all of which are known to those skilled in the art. Re-refined oils may be obtained by treating used and/or refined oils in processes similar to those used to obtain refined oils in the first place. Such re-refined oils may be known as reclaimed or reprocessed oils and may often additionally be processed by techniques for removal of spent additives and oil breakdown products.

Another additional or alternative class of suitable lubricating oils may include those basestocks produced from oligomerization of natural gas feed stocks or isomerization of waxes. These basestocks can be referred to in any number of ways but commonly they are known as Gas-to-Liquid (GTL) or Fischer-Tropsch basestocks.

The lubricating oil basestock according to the present disclosure may be a blend of one or more of the oils/basestocks described herein, whether of a similar or different type, and a blend of natural and synthetic lubricating oils (i.e., partially synthetic) is expressly contemplated for this disclosure.

Lubricating oils can be classified as set out in the American Petroleum Institute (API) publication "Engine Oil Licensing and Certification System", Industry Services Department, Fourteenth Edition, December 1996, Addendum 1, December 1998, in which oils are categorized as follows:

a) Group I basestocks contain less than 90 percent saturates and/or greater than 0.03 percent sulfur and have a viscosity index greater than or equal to 80 and less than 120;
b) Group II basestocks contain greater than or equal to 90 percent saturates and less than or equal to 0.03 percent sulfur and have a viscosity index greater than or equal to 80 and less than 120;
c) Group III basestocks contain greater than or equal to 90 percent saturates and less than or equal to 0.03 percent sulfur and have a viscosity index greater than or equal to 120;
d) Group IV basestocks are polyalphaolefins (PAO); and,
e) Group V basestocks include all other basestock oils not included in Groups I, II, III, or IV.

In an embodiment of the present disclosure, the lubricating oil may comprise or be a mineral oil or a mixture of mineral oils, in particular mineral oils of Group II and/or Group III (of the API classification). Additionally or alternatively, the lubricating oil may comprise or be a synthetic oil such as a polyalphaolefin (Group IV) and/or an oil of Group V.

Advantageously, the manual or automatic transmission fluid composition may exhibit a kinematic viscosity at 100° C. (KV100), as measured by ASTM D445, of up to 20 cSt (e.g., up to 15 cSt, up to 12 cSt, up to 10 cSt, up to 8 cSt, up to 7 cSt, up to 6.5 cSt, up to 6.0 cSt, up to 5.5 cSt, up to 5.0 cSt, up to 4.5 cSt, up to 4.0 cSt, up to 3.5 cSt, up to 3.0 cSt, up to 2.5 cSt, up to 2.0 cSt, from 1 cSt to 20 cSt, from 1 cSt to 15 cSt, from 1 cSt to 12 cSt, from 1 cSt to 10 cSt, from 1 cSt to 8 cSt, from 1 cSt to 7 cSt, from 1 cSt to 6.5 cSt, from 1 cSt to 6.0 cSt, from 1 cSt to 5.5 cSt, from 1 cSt to 5.0 cSt, from 1 cSt to 4.5 cSt, from 1 cSt to 4.0 cSt, from 1 cSt to 3.5 cSt, from 1 cSt to 3.0 cSt, from 1 cSt to 2.5 cSt, from 1 cSt to 2.0 cSt, from 2 cSt to 20 cSt, from 2 cSt to 15 cSt, from 2 cSt to 12 cSt, from 2 cSt to 10 cSt, from 2 cSt to 8 cSt, from 2 cSt to 7 cSt, from 2 cSt to 6.5 cSt, from 2 cSt to 6.0 cSt, from 2 cSt to 5.5 cSt, from 2 cSt to 5.0 cSt, from 2 cSt to 4.5 cSt, from 2 cSt to 4.0 cSt, from 2 cSt to 3.5 cSt, from 2 cSt to 3.0 cSt, from 2 cSt to 2.5 cSt, from 2.5 cSt to 20 cSt, from 2.5 cSt to 15 cSt, from 2.5 cSt to 12 cSt, from 2.5 cSt to 10 cSt, from 2.5 cSt to 8 cSt, from 2.5 cSt to 7 cSt, from 2.5 cSt to 6.5 cSt, from 2.5 cSt to 6.0 cSt, from 2.5 cSt to 5.5 cSt, from 2.5 cSt to 5.0 cSt, from 2.5 cSt to 4.5 cSt, from 2.5 cSt to 4.0 cSt, from 2.5 cSt to 3.5 cSt, from 2.5 cSt to 3.0 cSt, from 3 cSt to 20 cSt, from 3 cSt to 15 cSt, from 3 cSt to 12 cSt, from 3 cSt to 10 cSt, from 3 cSt to 8 cSt, from 3 cSt to 7 cSt, from 3 cSt to 6.5 cSt, from 3 cSt to 6.0 cSt, from 3 cSt to 5.5 cSt, from 3 cSt to 5.0 cSt, from 3 cSt to 4.5 cSt, from 3 cSt to 4.0 cSt, from 3 cSt to 3.5 cSt, from 3.5 cSt to 20 cSt, from 3.5 cSt to 15 cSt, from 3.5 cSt to 12 cSt, from 3.5 cSt to 10 cSt, from 3.5 cSt to 8 cSt, from 3.5 cSt to 7 cSt, from 3.5 cSt to 6.5 cSt, from 3.5 cSt to 6.0 cSt, from 3.5 cSt to 5.5 cSt, from 3.5 cSt to 5.0 cSt, from 3.5 cSt to 4.5 cSt, from 3.5 cSt to 4.0 cSt, from 4 cSt to 20 cSt, from 4 cSt to 15 cSt, from 4 cSt to 12 cSt, from 4 cSt to 10 cSt, from 4 cSt to 8 cSt, from 4 cSt to 7 cSt, from 4 cSt to 6.5 cSt, from 4 cSt to 6.0 cSt, from 4 cSt to 5.5 cSt, from 4 cSt to 5.0 cSt, or from 4 cSt to 4.5 cSt), in particular from 1 cSt to 20 cSt, such as from 2 cSt to 10 cSt, from 2 cSt to 8 cSt, or from 2.5 cSt to 6.5 cSt.

Anti-Wear Components

The transmission fluid booster additive package compositions and/or transmission fluid compositions according to the present disclosure can contain two different classes of anti-wear components, i.e., phosphorus-containing compounds of component (i) and ether/thioether compounds of component (ii).

Component (i) may advantageously comprise a mixture of two or more compounds of the structures (I):

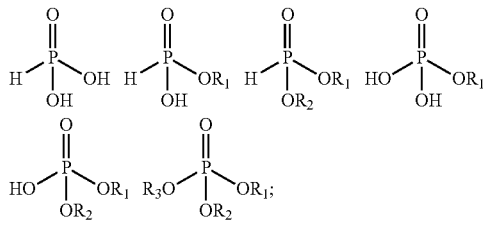

(I)

where groups $R_1$, $R_2$, and $R_3$ may each independently comprise or be alkyl groups having 1 to 18 carbon atoms and/or alkyl groups having 1 to 18 carbon atoms where the alkyl chain is interrupted by a thioether linkage, with the proviso that at least some of groups $R_1$, $R_2$, and $R_3$ may comprise or be alkyl groups having 1 to 18 carbon atoms where the alkyl chain is interrupted by a thioether linkage. The mixture may comprise three or more, four or more, or five or more compounds of the structures (I).

In some embodiments, groups $R_1$, $R_2$, and $R_3$ may each independently comprise or be alkyl groups having 4 to 10 carbon atoms and/or alkyl groups having 4 to 10 carbon atoms where the alkyl chain is interrupted by a thioether linkage, with the proviso that at least some of groups $R_1$, $R_2$, and $R_3$ may comprise or be alkyl groups having 4 to 10 carbon atoms where the alkyl chain is interrupted by a thioether linkage.

When groups $R_1$, $R_2$, and $R_3$ comprise alkyl groups (in which the alkyl chain is not interrupted by a thioether linkage), examples may include but are not limited to methyl, ethyl, propyl, and butyl, in particular including or being butyl.

When groups $R_1$, $R_2$, and $R_3$ comprise alkyl groups where the alkyl chain is interrupted by a thioether linkage, examples include groups of the structure —R'—S—R" where R' may be —$(CH_2)_n$—, in which n may be an integer from 2 to 4, and where R" may be —$(CH_2)_m$—$CH_3$, in which m may be an integer from 1 to 17, such as from 3 to 9.

In particular, in the mixture of compounds of structure (I) comprising component (i), at least 10% (e.g., at least 20%, at least 30%, or at least 40%) by mass of the mixture comprises compounds of structure (I) in which at least one of $R_1$, $R_2$, and $R_3$ comprises or is an alkyl group where the alkyl chain is interrupted by a thioether linkage, particularly having the structure —R'—S—R", where R' may be —$(CH_2)_n$—, in which n may be an integer from 2 to 4, and where R" may be —$(CH_2)_m$—$CH_3$, in which m may be an integer from 1 to 17, such as from 3 to 9.

Component (ii) may advantageously comprise one or more compounds of structures (II):

$$R_4—S—R_5—O—R_7$$

$$R_4—S—R_5—O—R_6—S—R_7 \quad (II)$$

where groups $R_4$ and $R_7$ may each independently comprise or be alkyl groups having 1 to 12 carbon atoms, and where $R_5$ and $R_6$ may each independently comprise or be alkyl linkages having 2 to 12 carbon atoms. In particular, $R_4$ and $R_7$ may each independently comprise or be —$(CH_2)_m$—$CH_3$, where m is an integer from 1 to 17, such as from 3 to 9, and $R_5$ and $R_6$ may each independently comprise or be —$(CH_2)_n$—, where n is an integer from 2 to 4. The mixture may comprise two or more or three or more compounds of the structures (II).

In particular, compounds of structure (I) (Component (i)) and compounds of structure (II) (Component (ii)) may each be present in booster additive package compositions according to the present disclosure in an amount from 0.5 to 6.0% by mass, based on the total mass of the booster additive package, e.g., from 0.7 to 5.0% by mass, from 0.8 to 4.0% by mass, or from 0.9 to 3.2% by mass, and/or present in rejuvenated transmission fluid compositions according to the present disclosure in an amount from 0.03 to 1.2% by mass, based on the total mass of the rejuvenated composition, e.g., from 0.05 to 0.8% by mass, from 0.06 to 0.5% by mass, or from 0.07 to 0.3% by mass. Additionally or alternatively, in particular, compounds of structure (I) (Component (i)) and compounds of structure (II) (Component (ii)) may collectively provide booster additive package compositions according to the present disclosure with from 350 to 5000 parts per million by mass of phosphorus, based on the total mass of the booster additive package, e.g., from 500 to 3800 ppm, from 600 to 3000 ppm, or from 700 to 2500 ppm, and/or may provide rejuvenated transmission fluid compositions according to the present disclosure with from 35 to 500 parts per million by mass of phosphorus, based on the total mass of the rejuvenated composition, e.g., from 50 to 380 ppm, from 60 to 300 ppm, or from 70 to 250 ppm. Phosphorus content can be measured in accordance with ASTM D5185. Further additionally or alternatively, in particular, a mass ratio of compounds of structure (I) (Component (i)) and compounds of structure (II) (Component (ii)) may be from 2:1 to 1:2, from 3:2 to 2:3, or from 4:3 to 3:4.

Ashless Dispersants

In particular, the transmission fluid booster additive package compositions and/or transmission fluid compositions according to the present disclosure may further comprise one or more ashless dispersants.

Examples of ashless dispersants may include polyisobutenyl succinimides, polyisobutenyl succinamides, mixed ester/amides/imides of polyisobutenyl-substituted succinic acid, hydroxyesters of polyisobutenyl-substituted succinic acid, and Mannich condensation products of hydrocarbyl-substituted phenols, formaldehyde, and polyamines, as well as reaction products and mixtures thereof.

Basic nitrogen-containing ashless dispersants are well-known lubricating oil additives and methods for their preparation are extensively described in the patent literature. Exemplary dispersants may include the polyisobutenyl succinimides and succinamides in which the polyisobutenyl-substituent is a long-chain of greater than 36 carbons, e.g., greater than 40 carbon atoms. These materials can be readily made by reacting a polyisobutenyl-substituted dicarboxylic acid material with a molecule containing amine functionality. Examples of suitable amines may include polyamines such as polyalkylene polyamines, hydroxy-substituted polyamines, polyoxyalkylene polyamines, and combinations thereof. The amine functionality may be provided by polyalkylene polyamines such as tetraethylene pentamine and pentaethylene hexamine. Mixtures where the average number of nitrogen atoms per polyamine molecule is greater than 7 are also available. These are commonly called heavy polyamines or H-PAMs and may be commercially available under trade names such as HPA™ and HPA-X™ from DowChemical, E-100™ from Huntsman Chemical, et al. Examples of hydroxy-substituted polyamines may include N-hydroxyalkyl-alkylene polyamines such as N-(2-hydroxyethyl)ethylene diamine, N-(2-hydroxyethyl)piperazine, and/or N-hydroxyalkylated alkylene diamines of the type described, for example, in U.S. Pat. No. 4,873,009. Examples of polyoxyalkylene polyamines may include polyoxyethylene and polyoxypropylene diamines and triamines having an average Mn from about 200 to about 2500 Daltons. Products of this type may be commercially available under the tradename Jeffamine™.

As is known in the art, reaction of the amine with the polyisobutenyl-substituted dicarboxylic acid material (suitably an alkenyl succinic anhydride or maleic anhydride) can be conveniently achieved by heating the reactants together, e.g., in an oil solution. Reaction temperatures of ~100° C. to ~250° C. and reaction times from ~1 to ~10 hours may be typical. Reaction ratios can vary considerably, but generally from about 0.1 to about 1.0 equivalents of dicarboxylic acid unit content may be used per reactive equivalent of the amine-containing reactant.

Additionally or alternatively, an exemplary ashless dispersant can have the following formula:

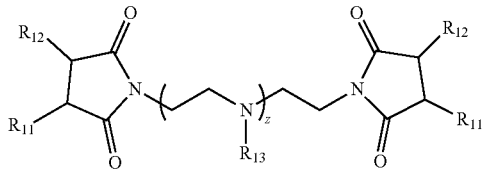

wherein each $R_{11}$ and $R_{12}$ may individually be hydrogen or a hydrocarbyl group, provided that $R_{11}$ and $R_{12}$ connected to the same succinimide ring are not both hydrogen; z may be an integer from 0 to 10, such as from 1 to 8; and each $R_{13}$ may individually be hydrogen, an acetyl group, a —$CH_2$—$CH_2$—$N(R_{13})_2$ group, or a branched succinimide of the formula:

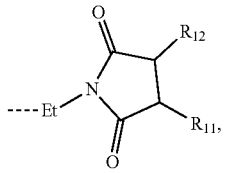

or wherein two proximate $R_{13}$ groups connected to different nitrogen atoms may connect together, e.g., using an ethylene bridge to form a piperazinyl group.

In order to properly function as a dispersant, relative to a similar chemical structure that primarily functions as a friction modifier (as described below), the hydrocarbyl group on each succinimide ring (i.e., the relevant $R_{11}$ alone if $R_{12}$ is hydrogen, the relevant $R_{12}$ alone if $R_{11}$ is hydrogen, or a combination of the relevant $R_{11}$ and $R_{12}$) may advantageously comprise greater than 36 carbons, in particular greater than 40 carbon atoms, greater than 44 carbon atoms, or greater than 48 carbon atoms. When $R_{12}$ is hydrogen and $R_{11}$ is a polyisobutenyl chain, this structure describes the polyisobutenyl succinimides mentioned earlier. When $R_{11}$ is a polyalphaolefin (PAO) chain, such as a metallocene-catalyzed polyalphaolefin (mPAO) made by polymerizing 1-octene, 1-decene, and/or 1-dodecene, this structure describes an analogous polyalphaolefin succinimide dispersant. Just as with polyisobutenyl chains, additional or alternative examples of ashless dispersants may include polyalphaolefin succinamides, mixed ester/amides/imides of polyalphaolefin-substituted succinic acid, and/or hydroxyesters of polyalphaolefin-substituted succinic acid, as well as variations with imidazoline and/or oxazoline linkages in lieu of or in addition to the succinimides shown in the formula above. Examples of such PAO dispersants can be seen, e.g., in U.S. Patent Application Publication No. 2012/0264665.

In particular, the ashless dispersant may include a polyisobutenyl succinimide formed from polyisobutenyl succinic anhydride and a polyalkylene polyamine such as tetraethylene pentamine or H-PAM. The polyisobutenyl group may be derived from polyisobutene and may exhibit a number average molecular weight (Mn) from about 750 to about 5000 Daltons, e.g., from about 900 to about 2500 Daltons.

As is known in the art, dispersants may be post-treated (e.g., with a borating/boronating agent and/or with an inorganic acid of phosphorus). Suitable examples may be found, for instance, in U.S. Pat. Nos. 3,254,025, 3,502,677, and 4,857,214.

When used, an ashless dispersant may be present in transmission fluid compositions according to the present disclosure in an amount of from 0.1 mass % to 10 mass %, based on the mass of the transmission fluid composition, in particular from 0.5 mass % to 5.0 mass %. Additionally or alternatively, when used, an ashless dispersant may be present in booster additive package concentrates according to the present disclosure in an amount of at least 15 mass %, based on the mass of the booster additive package concentrate, e.g., at least 20 mass %, at least 25 mass %, at least 30 mass %, at least 35 mass %, at least 40 mass %, from 15 mass % to 65 mass %, from 15 mass % to 60 mass %, from 15 mass % to 55 mass %, from 15 mass % to 50 mass %, from 15 mass % to 45 mass %, from 15 mass % to 40 mass %, from 20 mass % to 65 mass %, from 20 mass % to 60 mass %, from 20 mass % to 55 mass %, from 20 mass % to 50 mass %, from 20 mass % to 45 mass %, from 20 mass % to 40 mass %, from 25 mass % to 65 mass %, from 25 mass % to 60 mass %, from 25 mass % to 55 mass %, from 25 mass % to 50 mass %, from 25 mass % to 45 mass %, from 25 mass % to 40 mass %, from 30 mass % to 65 mass %, from 30 mass % to 60 mass %, from 30 mass % to 55 mass %, from 30 mass % to 50 mass %, from 30 mass % to 45 mass %, from 30 mass % to 40 mass %, from 35 mass % to 65 mass %, from 35 mass % to 60 mass %, from 35 mass % to 55 mass %, from 35 mass % to 50 mass %, from 35 mass % to 45 mass %, or from 35 mass % to 40 mass %, in particular at least 20 mass %, at least 30 mass %, from 20 mass % to 55 mass %, or from 30 mass % to 50 mass %. A mixture of more than one ashless dispersant may be included in the booster additive package concentrate and/or the transmission fluid composition in which case, the amounts given herein refer to the total amount of the mixture of dispersants used.

Detergents

The transmission fluid booster additive package compositions and/or transmission fluid compositions according to the present disclosure may further comprise a detergent, such as a calcium-containing detergent. These detergents are typically sufficiently oil-soluble or dispersible such as to remain dissolved or dispersed in an oil in order to be transported by the oil to their intended site of action. Calcium-containing detergents are known in the art and include neutral and overbased calcium salts with acidic substances such as salicylic acids, sulfonic acids, carboxylic acids, alkyl phenols, sulfurized alkyl phenols and mixtures of these substances.

Neutral calcium-containing detergents are those detergents that contain stoichiometrically equivalent amounts of calcium in relation to the amount of (Lewis) acidic moieties present in the detergent. Thus, in general, neutral detergents can typically have a relatively low basicity, when compared to their overbased counterparts.

The term "overbased," for example in connection with calcium detergents, is used to designate the fact that the calcium component is present in stoichiometrically larger amounts than the corresponding (Lewis) acid component. The commonly employed methods for preparing the overbased salts involve heating a mineral oil solution of an acid with a stoichiometric excess of a neutralizing agent at an appropriate temperature (in this case, a calcium neutralizing agent, such as an oxide, hydroxide, carbonate, bicarbonate, sulfide, or combination thereof, at a temperature of about 50° C.) and filtering the resultant product. The use of a "promoter" in the neutralization step to aid the incorporation of a large excess of salt/base (in this case, calcium) likewise is known. Examples of compounds useful as a promoter may include, but are not necessarily limited to, phenolic substances such as phenol, naphthol, alkyl phenol, thiophenol, sulfurized alkylphenol, and condensation products of formaldehyde with a phenolic substance; alcohols such as methanol, 2-propanol, octanol, Cellosolve™ alcohol, Carbitol™ alcohol, ethylene glycol, stearyl alcohol, and cyclohexyl alcohol; amines such as aniline, phenylene diamine, phenothiazine, phenyl-β-naphthylamine, and dodecylamine; and combinations thereof. A particularly effective method for preparing the basic salts comprises mixing an acidic substance with an excess of calcium neutralizing agent and at least one alcohol promoter, and carbonating the mixture at an elevated temperature, such as from 60 to 200° C.

Examples of calcium-containing detergents useful in the transmission fluid compositions of the present disclosure may include, but are not necessarily limited to, neutral and/or overbased salts of such substances as calcium phenates; sulfurized calcium phenates (e.g., wherein each aromatic group has one or more aliphatic groups to impart hydrocarbon solubility); calcium sulfonates (e.g., wherein each sulfonic acid moiety is attached to an aromatic nucleus, which in turn usually contains one or more aliphatic substituents to impart hydrocarbon solubility); calcium salicylates (e.g., wherein the aromatic moiety is usually substituted by one or more aliphatic substituents to impart hydrocarbon solubility); calcium salts of hydrolyzed phosphosulfurized olefins (e.g., having 10 to 2000 carbon atoms) and/or of hydrolyzed phosphosulfurized alcohols and/or aliphatic-substituted phenolic compounds (e.g., having 10 to 2000 carbon atoms); calcium salts of aliphatic carboxylic acids and/or aliphatic substituted cycloaliphatic carboxylic acids; and combinations and/or reaction products thereof, as well as many other similar calcium salts of oil-soluble organic acids. Mixtures of neutral and/or overbased salts of two or more different acids can be used, if desired (e.g., one or more overbased calcium phenates with one or more overbased calcium sulfonates and/or one or more overbased calcium salicylates).

Methods for the production of oil-soluble neutral and overbased calcium detergents are well known to those skilled in the art and are extensively reported in the patent literature. Calcium-containing detergents may optionally be post-treated, e.g., borated/boronated. Methods for preparing borated/boronated detergents are well known to those skilled in the art, and are extensively reported in the patent literature.

When present, a calcium-containing detergent may advantageously comprise, consist essentially of, or consist of a neutral or overbased calcium phenate detergent, optionally plus a neutral or overbased calcium sulfonate detergent and/or a neutral or overbased calcium salicylate detergent.

Antioxidants

Antioxidants are sometimes referred to as oxidation inhibitors and may increase the resistance (or decrease the susceptibility) of the transmission fluid composition to oxidation. They may work by combining with and modifying oxidative agents, such as peroxides and other free radical-forming compounds, to render them harmless, e.g., by decomposing them or by rendering inert a catalyst or facilitator of oxidation. Oxidative deterioration can be evidenced by sludge in the fluid with increased use, by varnish-like deposits on metal surfaces, and sometimes by viscosity increase.

Examples of suitable antioxidants may include, but are not limited to, copper-containing antioxidants, sulfur-containing antioxidants, aromatic amine-containing and/or amide-containing antioxidants, hindered phenolic antioxidants, dithiophosphates and derivatives, and the like, as well as combinations and certain reaction products thereof. Some anti-oxidants may be ashless (i.e., may contain few, if any, metal atoms other than trace or contaminants). In most embodiments, one or more antioxidants (in particular, at least a combination of an aromatic amine antioxidant and a hindered phenolic antioxidant) is/are present in new (and fully formulated) vehicle transmission lubricant fluids and typically remains present in used vehicle transmission lubricant fluids. Because of that, when a transmission fluid booster additive package composition according to the present disclosure is added to a used vehicle transmission lubricant fluid to form a transmission fluid composition according to the present disclosure, the transmission fluid composition may typically comprise one or more antioxidants, but in some embodiments only from the used vehicle transmission lubricating fluid; in such embodiments, transmission fluid booster additive package compositions according to the present disclosure may comprise substantially no additional antioxidants (that are not subsumed within another additive having a different enumerated function—for example, phosphorus-containing anti-wear agents may have antioxidant character but do not qualify as additional antioxidants because of the anti-wear primary function of enumerated component (i)).

Corrosion Inhibitors

Corrosion inhibitors may be used to reduce the corrosion of metals and are often alternatively referred to as metal deactivators or metal passivators. Some corrosion inhibitors may alternatively be characterized as antioxidants.

Suitable corrosion inhibitors may include nitrogen and/or sulfur containing heterocyclic compounds such as triazoles (e.g., benzotriazoles), substituted thiadiazoles, imidazoles, thiazoles, tetrazoles, hydroxyquinolines, oxazolines, imidazolines, thiophenes, indoles, indazoles, quinolines, benzoxazines, dithiols, oxazoles, oxatriazoles, pyridines, piperazines, triazines and derivatives of any one or more thereof. A particular corrosion inhibitor is a benzotriazole represented by the structure:

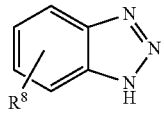

wherein $R^8$ is absent or is a $C_1$ to $C_{20}$ hydrocarbyl or substituted hydrocarbyl group which may be linear or branched, saturated or unsaturated. It may contain ring structures that are alkyl or aromatic in nature and/or contain heteroatoms such as N, O, or S. Examples of suitable compounds may include benzotriazole, alkyl-substituted benzotriazoles (e.g., tolyltriazole, ethylbenzotriazole, hexylbenzotriazole, octylbenzotriazole, etc.), aryl substituted benzotriazole, alkylaryl- or arylalkyl-substituted benzotriazoles, and the like, as well as combinations thereof. For instance, the triazole may comprise or be a benzotriazole and/or an alkylbenzotriazole in which the alkyl group contains from 1 to about 20 carbon atoms or from 1 to about 8 carbon atoms. A preferred corrosion inhibitor may comprise or be benzotriazole and/or tolyltriazole.

Additionally or alternatively, the corrosion inhibitor may include a substituted thiadiazoles represented by the structure:

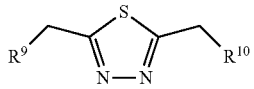

wherein $R^9$ and $R^{10}$ are independently hydrogen or a hydrocarbon group, which group may be aliphatic or aromatic, including cyclic, alicyclic, aralkyl, aryl and alkaryl. These substituted thiadiazoles are derived from the 2,5-dimercapto-1,3,4-thiadiazole (DMTD) molecule. Many derivatives of DMTD have been described in the art, and any such compounds can be included in the transmission fluid used in the present disclosure. For example, U.S. Pat. Nos. 2,719,125, 2,719,126, and 3,087,937 describe the preparation of various 2, 5-bis-(hydrocarbon dithio)-1,3,4-thiadiazoles.

Further additionally or alternatively, the corrosion inhibitor may include one or more other derivatives of DMTD, such as a carboxylic ester in which $R^9$ and $R^{10}$ may be joined to the sulfide sulfur atom through a carbonyl group. Preparation of these thioester containing DMTD derivatives is described, for example, in U.S. Pat. No. 2,760,933. DMTD derivatives produced by condensation of DMTD with alpha-halogenated aliphatic monocarboxylic acids having at least 10 carbon atoms are described, for example, in U.S. Pat. No. 2,836,564. This process produces DMTD derivatives wherein $R^9$ and $R^{10}$ are HOOC—CH($R^{19}$)— ($R^{19}$ being a hydrocarbyl group). DMTD derivatives further produced by amidation or esterification of these terminal carboxylic acid groups may also be useful.

The preparation of 2-hydrocarbyldithio-5-mercapto-1,3,4-thiadiazoles is described, for example, in U.S. Pat. No. 3,663,561.

A particular class of DMTD derivatives may include mixtures of a 2-hydrocarbyldithio-5-mercapto-1,3,4-thiadiazole and a 2,5-bis-hydrocarbyldithio-1,3,4-thiadiazole. Such mixtures may be sold under the tradename HiTEC® 4313 and are commercially available from Afton Chemical.

When used, corrosion inhibitors may be present in any effective amount, but may typically be used in transmission fluid compositions in amounts from about 0.001 mass % to 3.0 mass %, based on the mass of the transmission fluid composition, e.g., from 0.003 mass % to 1.0 mass % or from 0.005 mass % to 0.5 mass %. Additionally or alternatively, when used, corrosion inhibitors may be present in booster additive package concentrates in amounts from about 0.01 mass % to 10 mass %, based on the mass of the booster additive package concentrate, e.g., from 0.03 mass % to 5.0 mass % or from 0.05 mass % to 2.0 mass %.

Friction Modifiers

Friction modifiers may include derivatives of polyethylene polyamines and/or ethoxylated long chain amines. The derivatives of polyethylene polyamines may advantageously include succinimides of a defined structure or may be simple amides.

Suitable succinimides derived from polyethylene polyamines may include those of the following structure:

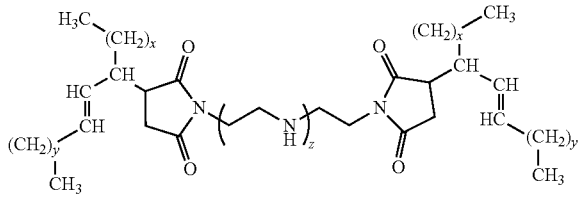

wherein x+y may be from 8 to 15 and z may be 0 or an integer from 1 to 5, in particular wherein x+y may be from 11 to 15 (e.g., 13) and z may be from 1 to 3. Preparation of such friction modifiers is described, for example, in U.S. Pat. No. 5,840,663.

The above succinimides may be post-reacted with acetic anhydride to form friction modifiers exemplified by the following structure (in which z=1):

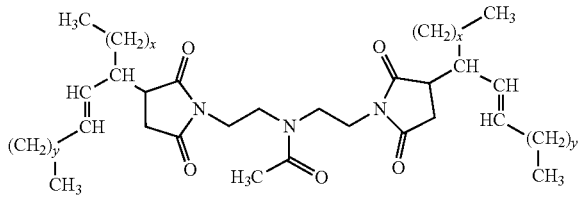

Preparation of this friction modifier is known and can be found, e.g., in U.S. Patent Application Publication No. 2009/0005277. Post reaction with other reagents, e.g., borating/boronating agents, is also known in the art.

When present, such succinimide friction modifiers may be used in any effective amount. Typically, in transmission fluid compositions, they may be used in amounts from 0.1 mass % to 10 mass %, based on the mass of the transmission fluid composition, e.g., from 0.3 mass % to 6.0 mass % or from 0.5 mass % to 3.0 mass %. Additionally or alternatively, when used, succinimide friction modifiers may be present in booster additive package concentrates in amounts from about 0.5 mass % to 50 mass %, based on the mass of the booster additive package concentrate, e.g., from 1.0 mass % to 40 mass % or from 3.0 mass % to 30 mass %.

An example of an alternative simple amide may have the following structure:

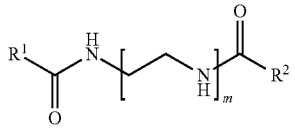

wherein $R^1$ and $R^2$ may be the same or different alkyl groups. For example, $R^1$ and $R^2$ may be $C_{14}$ to $C_{20}$ alkyl groups, which may be linear or branched, and m can be an integer from 1 to 5. In particular, $R^1$ and $R^2$ may both be derived from iso-stearic acid, and m may be 4.

When present, such simple amide friction modifiers may be used in any effective amount. Typically, in transmission fluid compositions, they may be used in amounts from 0.01 mass % to 5.0 mass %, based on the mass of the transmission fluid composition, e.g., from 0.03 mass % to 2.0 mass % or from 0.05 mass % to 1.0 mass %. Additionally or alternatively, when used, simple amide friction modifiers may be present in booster additive package concentrates in amounts from about 0.1 mass % to 15 mass %, based on the mass of the booster additive package concentrate, e.g., from 0.3 mass % to 8.0 mass % or from 0.5 mass % to 4.0 mass %.

Suitable ethoxylated amine friction modifiers may include or be reaction products of primary amines and/or diamines with ethylene oxide. The reaction with ethylene oxide may be suitably carried out using a stoichiometry such that substantially all primary and secondary amines may be converted to tertiary amines. Such amines may have the exemplary structures:

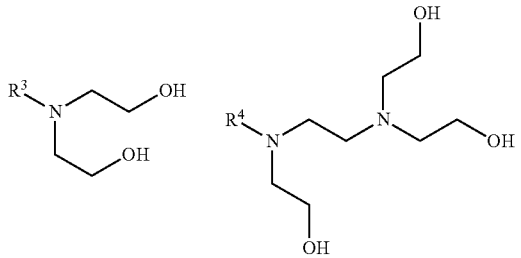

wherein $R^3$ and $R^4$ may be alkyl groups, or alkyl groups containing sulfur or oxygen linkages, containing from about 10 to 20 carbon atoms. Exemplary ethoxylated amine friction modifiers may include materials in which $R^3$ and/or $R^4$ may contain from 16 to 20 carbon atoms, e.g., from 16 to 18 carbon atoms. Materials of this type may be commercially available and sold under the tradenames of Ethomeen® and Ethoduomeen® by Akzo Nobel. Suitable materials from Akzo Nobel may include Ethomeen® T/12 and Ethoduomeen® T/13, inter alia.

When present, such ethoxylated amine friction modifiers may be used in any effective amount. Typically, in transmission fluid compositions, they may be used in amounts from 0.01 mass % to 4.0 mass %, based on the mass of the transmission fluid composition, e.g., from 0.02 mass % to 1.5 mass % or from 0.03 mass % to 0.8 mass %. Additionally or alternatively, when used, ethoxylated amine friction modifiers may be present in booster additive package concentrates in amounts from about 0.1 mass % to 10 mass %, based on the mass of the booster additive package concentrate, e.g., from 0.2 mass % to 6.0 mass % or from 0.3 mass % to 3.0 mass %.

However, in some embodiments, particularly in embodiments in which the transmission fluid compositions are used in conjunction with hybrid or fully electric engines, the transmission fluid compositions may optionally contain substantially no friction modifiers, or alternatively substantially no friction modifiers of the type(s) described herein.

Other Additives

Other additives known in the art may optionally be added to the transmission fluids, such as but not limited to other anti-wear agents, extreme pressure additives, viscosity modifiers, and the like. They are typically disclosed in, for example, "Lubricant Additives" by C. V. Smallheer and R. Kennedy Smith, 1967, pp 1-11.

Compositional Attributes

The transmission fluid booster additive package compositions and the rejuvenated lubricating oil compositions according to the present disclosure may exhibit particular concentrations (contents) of different elements.

For instance, transmission fluid booster additive package compositions according to the present disclosure may exhibit a boron content of at least 0.02 mass %, e.g., at least 0.03 mass %, at least 0.04 mass %, at least 0.05 mass %, at least 0.07 mass %, at least 0.1 mass %, at least 0.12 mass %, at least 0.15 mass %, at least 0.17 mass %, at least 0.2 mass %, at least 0.22 mass %, at least 0.25 mass %, at least 0.27 mass %, at least 0.3 mass %, from 0.02 mass % to 1.2 mass %, from 0.02 mass % to 1.0 mass %, from 0.02 mass % to 0.9 mass %, from 0.02 mass % to 0.8 mass %, from 0.02 mass % to 0.75 mass %, from 0.02 mass % to 0.7 mass %, from 0.02 mass % to 0.65 mass %, from 0.02 mass % to 0.6 mass %, from 0.02 mass % to 0.55 mass %, from 0.02 mass % to 0.5 mass %, from 0.02 mass % to 0.2 mass %, from 0.02 mass % to 0.1 mass %, from 0.03 mass % to 1.2 mass %, from 0.03 mass % to 1.0 mass %, from 0.03 mass % to 0.9 mass %, from 0.03 mass % to 0.8 mass %, from 0.03 mass % to 0.75 mass %, from 0.03 mass % to 0.7 mass %, from 0.03 mass % to 0.65 mass %, from 0.03 mass % to 0.6 mass %, from 0.03 mass % to 0.55 mass %, from 0.03 mass % to 0.5 mass %, from 0.03 mass % to 0.2 mass %, from 0.03 mass % to 0.1 mass %, from 0.04 mass % to 1.2 mass %, from 0.04 mass % to 1.0 mass %, from 0.04 mass % to 0.9 mass %, from 0.04 mass % to 0.8 mass %, from 0.04 mass % to 0.75 mass %, from 0.04 mass % to 0.7 mass %, from 0.04 mass % to 0.65 mass %, from 0.04 mass % to 0.6 mass %, from 0.04 mass % to 0.55 mass %, from 0.04 mass % to 0.5 mass %, from 0.04 mass % to 0.2 mass %, from 0.04 mass % to 0.1 mass %, from 0.05 mass % to 1.2 mass %, from 0.05 mass % to 1.0 mass %, from 0.05 mass % to 0.9 mass %, from 0.05 mass % to 0.8 mass %, from 0.05 mass % to 0.75 mass %, from 0.05 mass % to 0.7 mass %, from 0.05 mass % to 0.65 mass %, from 0.05 mass % to 0.6 mass %, from 0.05 mass % to 0.55 mass %, from 0.05 mass % to 0.5 mass %, from 0.05 mass % to 0.2 mass %, from 0.05 mass % to 0.1 mass %, from 0.07 mass % to 1.2 mass %, from 0.07 mass % to 1.0 mass %, from 0.07 mass % to 0.9 mass %, from 0.07 mass % to 0.8 mass %, from 0.07 mass % to 0.75 mass %, from 0.07 mass % to 0.7 mass %, from 0.07 mass % to 0.65 mass %, from 0.07 mass % to 0.6 mass %, from 0.07 mass % to 0.55 mass %, from 0.07 mass % to 0.5 mass %, from 0.07 mass % to 0.2 mass %, from 0.07 mass % to 0.1 mass %, from 0.1 mass % to 1.2 mass %, from 0.1 mass % to 1.0 mass %, from 0.1 mass % to 0.9 mass %, from 0.1 mass % to 0.8 mass %, from 0.1 mass % to 0.75 mass %, from 0.1 mass % to 0.7 mass %, from 0.1 mass % to 0.65 mass %, from 0.1 mass % to 0.6 mass %, from 0.1 mass % to 0.55 mass %, from 0.1 mass % to 0.5 mass %, from 0.15 mass % to 1.2 mass %, from 0.15 mass % to 1.0 mass %, from 0.15 mass % to 0.9 mass %, from 0.15 mass % to 0.8 mass %, from 0.15 mass % to 0.75 mass %, from 0.15 mass % to 0.7 mass %, from 0.15 mass % to 0.65 mass %, from 0.15 mass % to 0.6 mass %, from 0.15 mass % to 0.55 mass %, from 0.15 mass % to 0.5 mass %, from 0.2 mass % to 1.2 mass %, from 0.2 mass % to 1.0 mass %, from 0.2 mass % to 0.9 mass %, from 0.2 mass % to 0.8 mass %, from 0.2 mass % to 0.75 mass %, from 0.2 mass % to 0.7 mass %, from 0.2 mass % to 0.65 mass %, from 0.2 mass % to 0.6 mass %, from 0.2 mass % to 0.55 mass %, from 0.2 mass % to 0.5 mass %, from 0.25 mass % to 1.2 mass %, from 0.25 mass % to 1.0 mass %, from 0.25 mass % to 0.9 mass %, from 0.25 mass % to 0.8 mass %, from 0.25 mass % to 0.75 mass %, from 0.25 mass % to 0.7 mass %, from 0.25 mass % to 0.65 mass %, from 0.25 mass % to 0.6 mass %, from 0.25 mass % to 0.55 mass %, from 0.25 mass % to 0.5 mass %, from 0.3 mass % to 1.2 mass %, from 0.3 mass % to 1.0 mass %, from 0.3 mass % to 0.9 mass %, from 0.3 mass % to 0.8 mass %, from 0.3 mass % to 0.75 mass %, from 0.3 mass % to 0.7 mass %, from 0.3 mass % to 0.65 mass %, from 0.3 mass % to 0.6 mass %, from 0.3 mass % to 0.55 mass %, or from 0.3 mass % to 0.5 mass %, based on the total mass of the additive package composition, in particular at least 0.04 mass % or from 0.04 mass % to 0.75 mass %.

Additionally or alternatively, rejuvenated lubricating oil compositions according to the present disclosure may exhibit a boron content of at least 30 parts per million by mass, e.g., at least 50 ppm, at least 70 ppm, at least 85 ppm, at least 100 ppm, at least 110 ppm, at least 120 ppm, at least 130 ppm, at least 140 ppm, at least 150 ppm, at least 160 ppm, at least 170 ppm, at least 180 ppm, at least 190 ppm, at least 200 ppm, from 30 ppm to 750 ppm, from 30 ppm to 600 ppm, from 30 ppm to 500 ppm, from 30 ppm to 450 ppm, from 30 ppm to 400 ppm, from 30 ppm to 350 ppm, from 30 ppm to 300 ppm, from 30 ppm to 270 ppm, from 30 ppm to 250 ppm, from 30 ppm to 220 ppm, from 30 ppm to 200 ppm, from 30 ppm to 150 ppm, from 50 ppm to 750 ppm, from 50 ppm to 600 ppm, from 50 ppm to 500 ppm, from 50 ppm to 450 ppm, from 50 ppm to 400 ppm, from 50 ppm to 350 ppm, from 50 ppm to 300 ppm, from 50 ppm to 270 ppm, from 50 ppm to 250 ppm, from 50 ppm to 220 ppm, from 50 ppm to 200 ppm, from 50 ppm to 150 ppm, from 70 ppm to 750 ppm, from 70 ppm to 600 ppm, from 70 ppm to 500 ppm, from 70 ppm to 450 ppm, from 70 ppm to 400 ppm, from 70 ppm to 350 ppm, from 70 ppm to 300 ppm, from 70 ppm to 270 ppm, from 70 ppm to 250 ppm, from 70 ppm to 220 ppm, from 70 ppm to 200 ppm, from 70 ppm to 150 ppm, from 85 ppm to 750 ppm, from 85 ppm to 600 ppm, from 85 ppm to 500 ppm, from 85 ppm to 450 ppm, from 85 ppm to 400 ppm, from 85 ppm to 350 ppm, from 85 ppm to 300 ppm, from 85 ppm to 270 ppm, from 85 ppm to 250 ppm, from 85 ppm to 220 ppm, from 85 ppm to 200 ppm, from 100 ppm to 750 ppm, from 100 ppm to 600 ppm, from 100 ppm to 500 ppm, from 100 ppm to 450 ppm, from 100 ppm to 400 ppm, from 100 ppm to 350 ppm, from 100 ppm to 300 ppm, from 100 ppm to 270 ppm, from 100 ppm to 250 ppm, from 100 ppm to 220 ppm, from 110 ppm to 200 ppm, from 110 ppm to 750 ppm, from 110 ppm to 600 ppm, from 110 ppm to 500 ppm, from 110 ppm to 450 ppm, from 110 ppm to 400 ppm, from 110 ppm to 350 ppm, from 110 ppm to 300 ppm, from 110 ppm to 270 ppm, from 110 ppm to 250 ppm, from 110 ppm to 220 ppm, from 110 ppm to 200 ppm, from 120 ppm to 750 ppm, from 120 ppm to 600 ppm, from 120 ppm to 500 ppm, from 120 ppm to 450 ppm, from 120 ppm to 400 ppm, from 120 ppm to 350 ppm, from 120 ppm to 300 ppm, from 120 ppm to 270 ppm, from 120 ppm to 250 ppm, from 120 ppm to 220 ppm, from 120 ppm to 200 ppm, from 130 ppm to 750 ppm, from 130 ppm to 600 ppm, from 130 ppm to 500 ppm, from 130 ppm to 450 ppm, from 130 ppm to 400 ppm, from 130 ppm to 350 ppm, from 130 ppm to 300 ppm, from 130 ppm to 270 ppm, from 130 ppm to 250 ppm, from 130 ppm to 220 ppm, from 130 ppm to 200 ppm, from 140 ppm to 750 ppm, from 140 ppm to 600 ppm, from 140 ppm to 500 ppm, from 140 ppm to 450 ppm, from 140 ppm to 400 ppm, from 140 ppm to 350 ppm, from 140 ppm to 300 ppm, from 140 ppm to 270 ppm, from 140 ppm to 250 ppm, from 140 ppm to 220 ppm, from 140 ppm to 200 ppm, from 150 ppm to 750 ppm, from 150 ppm to 600 ppm, from 150 ppm to 500 ppm, from 150 ppm to 450 ppm, from 150 ppm to 400 ppm, from 150 ppm to 350 ppm, from 150 ppm to 300 ppm, from 150 ppm to 270 ppm, from 150 ppm to 250 ppm, from 150 ppm to 220 ppm, or from 150 ppm to 200 ppm, based on the total mass of the rejuvenated lubricating oil composition, in particular at least 30 ppm, at least 85 ppm, from 30 ppm to 400 ppm, from 85 ppm to 300 ppm or from 30 ppm to 150 ppm.

Further additionally or alternatively, transmission fluid booster additive package compositions according to the present disclosure may exhibit a calcium content (from at least the detergent(s) and/or optionally from any other calcium-containing component) from 0.1 mass % to 3.5 mass %, e.g., from 0.1 mass % to 3.0 mass %, from 0.1 mass % to 2.5 mass %, from 0.1 mass % to 2.3 mass %, from 0.1 mass % to 2.0 mass %, from 0.1 mass % to 1.8 mass %, from 0.1 mass % to 1.5 mass %, from 0.1 mass % to 1.3 mass %, from 0.1 mass % to 1.0 mass %, from 0.1 mass % to 0.9 mass %, from 0.1 mass % to 0.8 mass %, from 0.1 mass % to 0.7 mass %, from 0.2 mass % to 3.5 mass %, from 0.2 mass % to 3.0 mass %, from 0.2 mass % to 2.5 mass %, from 0.2 mass % to 2.3 mass %, from 0.2 mass % to 2.0 mass %, from 0.2 mass % to 1.8 mass %, from 0.2 mass % to 1.5 mass %, from 0.2 mass % to 1.3 mass %, from 0.2 mass % to 1.0 mass %, from 0.2 mass % to 0.9 mass %, from 0.2 mass % to 0.8 mass %, from 0.2 mass % to 0.7 mass %, from 0.3 mass % to 3.5 mass %, from 0.3 mass % to 3.0 mass %, from 0.3 mass % to 2.5 mass %, from 0.3 mass % to 2.3 mass %, from 0.3 mass % to 2.0 mass %, from 0.3 mass % to 1.8 mass %, from 0.3 mass % to 1.5 mass %, from 0.3 mass % to 1.3 mass %, from 0.3 mass % to 1.0 mass %, from 0.3 mass % to 0.9 mass %, from 0.3 mass % to 0.8 mass %, from 0.3 mass % to 0.7 mass %, from 0.4 mass % to 3.5 mass %, from 0.4 mass % to 3.0 mass %, from 0.4 mass % to 2.5 mass %, from 0.4 mass % to 2.3 mass %, from 0.4 mass % to 2.0 mass %, from 0.4 mass % to 1.8 mass %, from 0.4 mass % to 1.5 mass %, from 0.4 mass % to 1.3 mass %, from 0.4 mass % to 1.0 mass %, from 0.4 mass % to 0.9 mass %, from 0.4 mass % to 0.8 mass %, from 0.4 mass % to 0.7 mass %, from 0.5 mass % to 3.5 mass %, from 0.5 mass % to 3.0 mass %, from 0.5 mass % to 2.5 mass %, from 0.5 mass % to 2.3 mass %, from 0.5 mass % to 2.0 mass %, from 0.5 mass % to 1.8 mass %, from 0.5 mass % to 1.5 mass %, from 0.5 mass % to 1.3 mass %, from 0.5 mass % to 1.0 mass %, from 0.5 mass % to 0.9 mass %, from 0.5 mass % to 0.8 mass %, from 0.5 mass % to 0.7 mass %, from 0.6 mass % to 3.5 mass %, from 0.6 mass % to 3.0 mass %, from 0.6 mass % to 2.5 mass %, from 0.6 mass % to 2.3 mass %, from 0.6 mass % to 2.0 mass %, from 0.6 mass % to 1.8 mass %, from 0.6 mass % to 1.5 mass %, from 0.6 mass % to 1.3 mass %, from 0.6 mass % to 1.0 mass %, from 0.6 mass % to 0.9 mass %, from 0.6 mass % to 0.8 mass %, or from 0.6 mass % to 0.7 mass %, based on the total mass of the additive package composition, in particular from 0.2 mass % to 2.0 mass %, from 0.3 mass % to 1.5 mass %, or from 0.3 mass % to 1.0 mass %.

Still further additionally or alternatively, rejuvenated lubricating oil compositions according to the present disclosure may exhibit a calcium content (from at least the detergent(s) and/or optionally from any other calcium-containing component) from 150 ppm to 7500 ppm (by mass), e.g., from 150 ppm to 6000 ppm, from 150 ppm to 5000 ppm, from 150 ppm to 4500 ppm, from 150 ppm to 4000 ppm, from 150 ppm to 3500 ppm, from 150 ppm to 3000 ppm, from 150 ppm to 2500 ppm, from 150 ppm to 2000 ppm, from 150 ppm to 1500 ppm, from 150 ppm to 1250 ppm, from 150 ppm to 1000 ppm, from 150 ppm to 800 ppm, from 150 ppm to 600 ppm, 250 ppm to 7500 ppm, from 250 ppm to 6000 ppm, from 250 ppm to 5000 ppm, from 250 ppm to 4500 ppm, from 250 ppm to 4000 ppm, from 250 ppm to 3500 ppm, from 250 ppm to 3000 ppm, from 250 ppm to 2500 ppm, from 250 ppm to 2000 ppm, from 250 ppm to 1500 ppm, from 250 ppm to 1250 ppm, from 250 ppm to 1000 ppm, from 250 ppm to 800 ppm, from 250 ppm to 600 ppm, from 300 ppm to 7500 ppm, from 300 ppm to 6000 ppm, from 300 ppm to 5000 ppm, from 300 ppm to 4500 ppm, from 300 ppm to 4000 ppm, from 300 ppm to 3500 ppm, from 300 ppm to 3000 ppm, from 300 ppm to 2500 ppm, from 300 ppm to 2000 ppm, from 300 ppm to 1500 ppm, from 300 ppm to 1250 ppm, from 300 ppm to 1000 ppm, from 300 ppm to 800 ppm, from 300 ppm to 600 ppm, from 350 ppm to 7500 ppm, from 350 ppm to 6000 ppm, from 350 ppm to 5000 ppm, from 350 ppm to 4500 ppm, from 350 ppm to 4000 ppm, from 350 ppm to 3500 ppm, from 350 ppm to 3000 ppm, from 350 ppm to 2500 ppm, from 350 ppm to 2000 ppm, from 350 ppm to 1500 ppm, from 350 ppm to 1250 ppm, from 350 ppm to 1000 ppm, from 350 ppm to 800 ppm, from 350 ppm to 600 ppm, from 400 ppm to 7500 ppm, from 400 ppm to 6000 ppm, from 400 ppm to 5000 ppm, from 400 ppm to 4500 ppm, from 400 ppm to 4000 ppm, from 400 ppm to 3500 ppm, from 400 ppm to 3000 ppm, from 400 ppm to 2500 ppm, from 400 ppm to 2000 ppm, from 400 ppm to 1500 ppm, from 400 ppm to 1250 ppm, from 400 ppm to 1000 ppm, from 400 ppm to 800 ppm, from 400 ppm to 600 ppm, from 450 ppm to 7500 ppm, from 450 ppm to 6000 ppm, from 450 ppm to 5000 ppm, from 450 ppm to 4500 ppm, from 450 ppm to 4000 ppm, from 450 ppm to 3500 ppm, from 450 ppm to 3000 ppm, from 450 ppm to 2500 ppm, from 450 ppm to 2000 ppm, from 450 ppm to 1500 ppm, from 450 ppm to 1250 ppm, from 450 ppm to 1000 ppm, from 450 ppm to 800 ppm, from 450 ppm to 600 ppm, from 500 ppm to 7500 ppm, from 500 ppm to 6000 ppm, from 500 ppm to 5000 ppm, from 500 ppm to 4500 ppm, from 500 ppm to 4000 ppm, from 500 ppm to 3500 ppm, from 500 ppm to 3000 ppm, from 500 ppm to 2500 ppm, from 500 ppm to 2000 ppm, from 500 ppm to 1500 ppm, from 500 ppm to 1250 ppm, from 500 ppm to 1000 ppm, from 500 ppm to 800 ppm, or from 500 ppm to 600 ppm, based on the total mass of the rejuvenated lubricating oil composition, in particular from 150 ppm to 2000 ppm, from 250 ppm to 800 ppm, from 300 ppm to 1250 ppm, or from 300 ppm to 1000 ppm.

Yet further additionally or alternatively, transmission fluid booster additive package compositions according to the present disclosure may exhibit a phosphorus content (from at least compounds of structure (I) and structure (II), and/or optionally from any other phosphorus-containing component) from 0.1 mass % to 3.5 mass %, e.g., from 0.1 mass % to 3.0 mass %, from 0.1 mass % to 2.5 mass %, from 0.1 mass % to 2.3 mass %, from 0.1 mass % to 2.0 mass %, from 0.1 mass % to 1.8 mass %, from 0.1 mass % to 1.5 mass %, from 0.1 mass % to 1.3 mass %, from 0.1 mass % to 1.0 mass %, from 0.1 mass % to 0.9 mass %, from 0.1 mass % to 0.8 mass %, from 0.1 mass % to 0.7 mass %, from 0.2 mass % to 3.5 mass %, from 0.2 mass % to 3.0 mass %, from 0.2 mass % to 2.5 mass %, from 0.2 mass % to 2.3 mass %, from 0.2 mass % to 2.0 mass %, from 0.2 mass % to 1.8 mass %, from 0.2 mass % to 1.5 mass %, from 0.2 mass % to 1.3 mass %, from 0.2 mass % to 1.0 mass %, from 0.2 mass % to 0.9 mass %, from 0.2 mass % to 0.8 mass %, from 0.2 mass % to 0.7 mass %, from 0.3 mass % to 3.5 mass %, from 0.3 mass % to 3.0 mass %, from 0.3 mass % to 2.5 mass %, from 0.3 mass % to 2.3 mass %, from 0.3 mass % to 2.0 mass %, from 0.3 mass % to 1.8 mass %, from 0.3 mass % to 1.5 mass %, from 0.3 mass % to 1.3 mass %, from 0.3 mass % to 1.0 mass %, from 0.3 mass % to 0.9 mass %, from 0.3 mass % to 0.8 mass %, from 0.3 mass % to 0.7 mass %, from 0.4 mass % to 3.5 mass %, from 0.4 mass % to 3.0 mass %, from 0.4 mass % to 2.5 mass %, from 0.4 mass % to 2.3 mass %, from 0.4 mass % to 2.0 mass %, from 0.4 mass % to 1.8 mass %, from 0.4 mass % to 1.5 mass %, from 0.4 mass % to 1.3 mass %, from 0.4 mass % to 1.0 mass %, from 0.4 mass % to 0.9 mass %, from 0.4 mass % to 0.8 mass %, from 0.4 mass % to 0.7 mass %, from 0.5 mass % to 3.5 mass %, from 0.5 mass % to 3.0 mass %, from 0.5 mass % to 2.5 mass %, from 0.5 mass % to 2.3 mass %, from 0.5 mass % to 2.0 mass %, from 0.5 mass % to 1.8 mass %, from 0.5 mass % to 1.5 mass %, from 0.5 mass % to 1.3 mass %, from 0.5 mass % to 1.0 mass %, from 0.5 mass % to 0.9 mass %, from 0.5 mass % to 0.8 mass %, from 0.5 mass % to 0.7 mass %, from 0.6 mass % to 3.5 mass %, from 0.6 mass % to 3.0 mass %, from 0.6 mass % to 2.5 mass %, from 0.6 mass % to 2.3 mass %, from 0.6 mass % to 2.0 mass %, from 0.6 mass % to 1.8 mass %, from 0.6 mass % to 1.5 mass %, from 0.6 mass % to 1.3 mass %, from 0.6 mass % to 1.0 mass %, from 0.6 mass % to 0.9 mass %, from 0.6 mass % to 0.8 mass %, or from 0.6 mass % to 0.7 mass %, based on the total mass of the additive package composition, in particular from 0.2 mass % to 2.0 mass %, from 0.3 mass % to 1.5 mass %, or from 0.3 mass % to 1.0 mass %.

Yet still further additionally or alternatively, rejuvenated lubricating oil compositions according to the present disclosure may exhibit a phosphorus content (from at least compounds of structure (I) and structure (II), and/or optionally from any other phosphorus-containing component) from 150 ppm to 7500 ppm (by mass), e.g., from 150 ppm to 6000 ppm, from 150 ppm to 5000 ppm, from 150 ppm to 4500 ppm, from 150 ppm to 4000 ppm, from 150 ppm to 3500 ppm, from 150 ppm to 3000 ppm, from 150 ppm to 2500 ppm, from 150 ppm to 2000 ppm, from 150 ppm to 1500 ppm, from 150 ppm to 1250 ppm, from 150 ppm to 1000 ppm, from 150 ppm to 800 ppm, from 150 ppm to 600 ppm, 250 ppm to 7500 ppm, from 250 ppm to 6000 ppm, from 250 ppm to 5000 ppm, from 250 ppm to 4500 ppm, from 250 ppm to 4000 ppm, from 250 ppm to 3500 ppm, from 250 ppm to 3000 ppm, from 250 ppm to 2500 ppm, from 250 ppm to 2000 ppm, from 250 ppm to 1500 ppm, from 250 ppm to 1250 ppm, from 250 ppm to 1000 ppm, from 250 ppm to 800 ppm, from 250 ppm to 600 ppm, from 300 ppm to 7500 ppm, from 300 ppm to 6000 ppm, from 300 ppm to 5000 ppm, from 300 ppm to 4500 ppm, from 300 ppm to 4000 ppm, from 300 ppm to 3500 ppm, from 300 ppm to 3000 ppm, from 300 ppm to 2500 ppm, from 300 ppm to 2000 ppm, from 300 ppm to 1500 ppm, from 300 ppm to 1250 ppm, from 300 ppm to 1000 ppm, from 300 ppm to 800 ppm, from 300 ppm to 600 ppm, from 350 ppm to 7500 ppm, from 350 ppm to 6000 ppm, from 350 ppm to 5000 ppm, from 350 ppm to 4500 ppm, from 350 ppm to 4000 ppm, from 350 ppm to 3500 ppm, from 350 ppm to 3000 ppm, from 350 ppm to 2500 ppm, from 350 ppm to 2000 ppm, from 350 ppm to 1500 ppm, from 350 ppm to 1250 ppm, from 350 ppm to 1000 ppm, from 350 ppm to 800 ppm, from 350 ppm to 600 ppm, from 400 ppm to 7500 ppm, from 400 ppm to 6000 ppm, from 400 ppm to 5000 ppm, from 400 ppm to 4500 ppm, from 400 ppm to 4000 ppm, from 400 ppm to 3500 ppm, from 400 ppm to 3000 ppm, from 400 ppm to 2500 ppm, from 400 ppm to 2000 ppm, from 400 ppm to 1500 ppm, from 400 ppm to 1250 ppm, from 400 ppm to 1000 ppm, from 400 ppm to 800 ppm, from 400 ppm to 600 ppm, from 450 ppm to 7500 ppm, from 450 ppm to 6000 ppm, from 450 ppm to 5000 ppm, from 450 ppm to 4500 ppm, from 450 ppm to 4000 ppm, from 450 ppm to 3500 ppm, from 450 ppm to 3000 ppm, from 450 ppm to 2500 ppm, from 450 ppm to 2000 ppm, from 450 ppm to 1500 ppm, from 450 ppm to 1250 ppm, from 450 ppm to 1000 ppm, from 450 ppm to 800 ppm, from 450 ppm to 600 ppm, from 500 ppm to 7500 ppm, from 500 ppm to 6000 ppm, from 500 ppm to 5000 ppm, from 500 ppm to 4500 ppm, from 500 ppm to 4000 ppm, from 500 ppm to 3500 ppm, from 500 ppm to 3000 ppm, from 500 ppm to 2500 ppm, from 500 ppm to 2000 ppm, from 500 ppm to 1500 ppm, from 500 ppm to 1250 ppm, from 500 ppm to 1000 ppm, from 500 ppm to 800 ppm, or from 500 ppm to 600 ppm, based on the total mass of the rejuvenated lubricating oil composition, in particular from 150 ppm to 2000 ppm, from 250 ppm to 800 ppm, from 300 ppm to 1250 ppm, or from 300 ppm to 1000 ppm.

Lubricant Fluid Composition Functional Characteristics

Advantageously, lubricating oil compositions according to the present disclosure, and/or made by combining a fresh or used lubricating oil basestock (alone or with one or more other components, such as a viscosity modifier and/or the like) with a booster additive package composition according to the present disclosure, can desirably exhibit certain functional characteristics, which are typically linked with and/or inexorably tied to the particular application(s) in which the lubricating oil compositions are desired to be used. For the purposes of the present disclosure, such lubricating oil composition functional characteristics may include, but are not necessarily limited to, anti-shudder durability (ASD) lifetime, paper-on-metal static friction coefficient ($\mu_s$), relatively low-velocity paper-on-metal dynamic friction coefficient ($\mu_5$; optionally as an alternative to/approximation of $\mu_s$), miscibility/suspension-stability, and/or optionally other functional characteristics, as well as combinations thereof.

As described in further detail below, ASD lifetime can be measured by constant pressure test methods (e.g., JASO M349), but it is believed that test methods utilizing constant torque measurements (e.g., modified JASO M349, as detailed in the Examples section herein) may provide an alternative/more accurate/more sensitive evaluation parameter. Thus, whether the booster additive package compositions according to the present disclosure are combined with one or more lubricating oil basestocks or with fresh (fully formulated) or used (actually or through simulated use) lubricating oil compositions containing a majority of lubricating oil basestock (including basestock mixtures), e.g., in a mass ratio of booster package to lubricating oil basestock(s)/(fresh/used) composition(s) of from 1:49 to 1:7, from 1:32 to 1:8, or from 1:24 to 1:9, the resulting rejuvenated lubricating oil composition (also according to the present disclosure) may advantageously exhibit one or more of the following:

(1) an ASD lifetime under constant torque conditions (e.g., using modified JASO M349) of at least 80 hours (e.g., at least 85 hours, at least 90 hours, at least 95 hours, at least 100 hours, at least 110 hours, at least 120 hours, from 80 hours to 320 hours, from 80 hours to 300 hours, from 80 hours to 280 hours, from 80 hours to 260 hours, from 80 hours to 240 hours, from 80 hours to 220 hours, from 80 hours to 200 hours, from 80 hours to 180 hours, from 80 hours to 160 hours, from 80 hours to 140 hours, from 80 hours to 120 hours, from 85 hours to 320 hours, from 85 hours to 300 hours, from 85 hours to 280 hours, from 85 hours to 260 hours, from 85 hours to 240 hours, from 85 hours to 220 hours, from 85 hours to 200 hours, from 85 hours to 180 hours, from 85 hours to 160 hours, from 85 hours to 140 hours, from 85 hours to 120 hours, from 90 hours to 320 hours, from 90 hours to 300 hours, from 90 hours to 280 hours, from 90 hours to 260 hours, from 90 hours to 240 hours, from 90 hours to 220 hours, from 90 hours to 200 hours, from 90 hours to 180 hours, from 90 hours to 160 hours, from 90 hours to 140 hours, from 90 hours to 120 hours, from 95 hours to 320 hours, from 95 hours to 300 hours, from 95 hours to 280 hours, from 95 hours to 260 hours, from 95 hours to 240 hours, from 95 hours to 220 hours, from 95 hours to 200 hours, from 95 hours to 180 hours, from 95 hours to 160 hours, from 95 hours to 140 hours, from 95 hours to 120 hours, from 100 hours to 320 hours, from 100 hours to 300 hours, from 100 hours to 280 hours, from 100 hours to 260 hours, from 100 hours to 240 hours, from 100 hours to 220 hours, from 100 hours to 200 hours, from 100 hours to 180 hours, from 100 hours to 160 hours, from 100 hours to 140 hours, from 100 hours to 120 hours, from 110 hours to 320 hours, from 110 hours to 300 hours, from 100 hours to 280 hours, from 110 hours to 260 hours, from 110 hours to 240 hours, from 100 hours to 220 hours, from 110 hours to 200 hours, from 110 hours to 180 hours, from 100 hours to 160 hours, from 110 hours to 140 hours, from 120 hours to 320 hours, from 120 hours to 300 hours, from 120 hours to 280 hours, from 120 hours to 260 hours, from 120 hours to 240 hours, from 120 hours to 220 hours, from 120 hours to 200 hours, from 120 hours to 180 hours, or from 120 hours to 160 hours);

(2) an increase in ASD lifetime under constant torque conditions (e.g., using modified JASO M349) of at least 35 hours, as compared to an ASD lifetime of the rejuvenated lubricating oil composition without the booster package (e.g., at least 40 hours, at least 45 hours, at least 50 hours, from 35 hours to 240 hours, from 35 hours to 220 hours, from 35 hours to 200 hours, from 35 hours to 180 hours, from 35 hours to 160 hours, from 35 hours to 140 hours, from 35 hours to 120 hours, from 35 hours to 100 hours, from 35 hours to 80 hours, from 35 hours to 60 hours, from 40 hours to 240 hours, from 40 hours to 220 hours, from 40 hours to 200 hours, from 40 hours to 180 hours, from 40 hours to 160 hours, from 40 hours to 140 hours, from 40 hours to 120 hours, from 40 hours to 100 hours, from 40 hours to 80 hours, from 40 hours to 60 hours, from 45 hours to 240 hours, from 45 hours to 220 hours, from 45 hours to 200 hours, from 45 hours to 180 hours, from 45 hours to 160 hours, from 45 hours to 140 hours, from 45 hours to 120 hours, from 45 hours to 100 hours, from 45 hours to 80 hours, from 45 hours to 60 hours, from 50 hours to 240 hours, from 50 hours to 220 hours, from 50 hours to 200 hours, from 50 hours to 180 hours, from 50 hours to 160 hours, from 50 hours to 140 hours, from 50 hours to 120 hours, from 50 hours to 100 hours, from 50 hours to 80 hours, or from 50 hours to 60 hours); and (3) an increase in ASD lifetime under constant torque conditions (e.g., using modified JASO M349) of at least 40%, as compared to an ASD lifetime of the rejuvenated lubricating oil composition without the booster package (e.g., at least 50%, at least 60%, at least 75%, at least 90%, from 40% to 300%, from 40% to 250%, from 40% to 200%, from 40% to 175%, from 40% to 150%, from 40% to 125%, from 40% to 100%, from 40% to 80%, from 40% to 60%, from 50% to 300%, from 50% to 250%, from 50% to 200%, from 50% to 175%, from 50% to 150%, from 50% to 125%, from 50% to 100%, from 50% to 80%, from 50% to 60%, from 60% to 300%, from 60% to 250%, from 60% to 200%, from 60% to 175%, from 60% to 150%, from 60% to 125%, from 60% to 100%, from 60% to 80%, from 75% to 300%, from 75% to 250%, from 75% to 200%, from 75% to 175%, from 75% to 150%, from 75% to 125%, from 75% to 100%, from 90% to 300%, from 90% to 250%, from 90% to 200%, from 40% to 175%, from 90% to 150%, from 90% to 125%, or from 90% to 100%).

Additionally or alternatively, whether the booster additive package compositions according to the present disclosure are combined with one or more lubricating oil basestocks or with fresh (fully formulated) or used (actually or through simulated use) lubricating oil compositions containing a majority of lubricating oil basestock (including basestock mixtures), the resulting rejuvenated lubricating oil composition (also according to the present disclosure) may advantageously exhibit one or more of the following:

(1) a coefficient of friction, μ, of at least 0.100 (e.g., at least 0.105, at least 0.110, at least 0.115, or at least 0.119, and optionally not greater than 0.140, not greater than 0.135, or not greater than 0.130), under LFW-1 standard test conditions (see, e.g., the JASO M358 (2005) standard test method) at a sliding speed of about 0.125 m/s, a temperature of about 110° C., and at an applied load of about 1.1 kN (~250 lbs);

(2) a coefficient of friction, μ(5), that is no more than 40% below (e.g., no more than 35% below, no more than 30% below, no more than 25% below, no more than 20% below, no more than 15% below, no more than 10% below, no more than 5% below, no more than 2% below, at or above, and optionally no greater than 2% above, no greater than 5% above, or no greater than 10% above) a corresponding coefficient of friction, μ(5), of the resulting rejuvenated lubricating oil composition without the booster package (e.g., as fresh fully formulated lubricating oil composition or as used/degraded formulated lubricating oil composition), in which (5) is measured according to the modified JASO M349 standard anti-shudder durability test conditions (constant torque) disclosed herein; and (3) where the rejuvenated lubricating oil composition comprises the booster package and a used version of a fully formulated (fresh) lubricating oil composition, a coefficient of friction, μ(5), that is no more than 30% below (e.g., no more than 25% below, no more than 20% below, no more than 15% below, no more than 10% below, no more than 5% below, no more than 2% below, at or above, and optionally no greater than 10% above, or no greater than 5% above) a corresponding coefficient of friction, μ(5), of the corresponding fresh (fully formulated) lubricating oil composition prior to use, in which μ(5) is measured according to the modified JASO M349 standard anti-shudder durability test conditions (constant torque) disclosed herein.

Additional Embodiments

Additionally or alternatively, the present disclosure may include one or more of the following embodiments.

Embodiment 1. A transmission fluid booster additive package composition comprising: (a) a mixture comprising: (i) two or more compounds of structures (I):

(I)

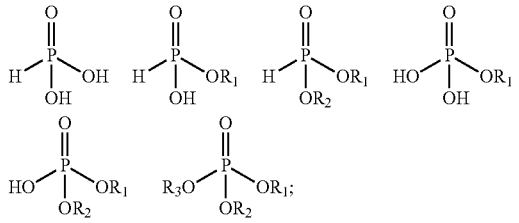

where groups $R_1$, $R_2$ and $R_3$ are independently alkyl groups having 1 to 18 carbon atoms or alkyl groups having 1 to 18 carbon atoms where the alkyl chain is interrupted by a thioether linkage, provided that, in component (i), at least some of groups $R_1$, $R_2$ and $R_3$ are alkyl groups having 1 to 18 carbon atoms where the alkyl chain is interrupted by a thioether linkage; and (ii) one or more compounds of structures (II):

$$R_4—S—R_5—O—R_7$$

$$R_4—S—R_5—O—R_6—S—R_7 \quad \text{(II)}$$

where groups $R_4$ and $R_7$ are independently alkyl groups having 1 to 12 carbon atoms and $R_5$ and $R_6$ are independently alkyl linkages having 2 to 12 carbon atoms; (b) an ashless dispersant representing at least 20 mass % of the transmission fluid booster additive package composition; (c) an overbased calcium phenate detergent; (d) at least two friction modifiers, a first of which comprises a polyethylene polyamine succinimide derivative; (e) a corrosion inhibitor; and (f) a suspension-stabilizing amount of a lubricating oil basestock, wherein the transmission fluid booster additive package composition exhibits: a boron content from 0.04 mass % to 0.75 mass %, based on the total mass of the additive package composition; a calcium content from 0.3 mass % to 1.5 mass %, based on the total mass of the additive package composition; and a phosphorus content from 0.3 mass % to 1.5 mass %, based on the total mass of the additive package composition.

Embodiment 2. A booster additive package composition according to embodiment 1, wherein the compounds of component (i) and component (ii) are present in the composition in a mass ratio of from 2:1 to 1:2.

Embodiment 3. A booster additive package composition according to embodiment 1 or embodiment 2, wherein the ashless dispersant comprises a polyisobutenyl succinimide.

Embodiment 4. A booster additive package composition according to any one of the previous embodiments, wherein the polyethylene polyamine succinimide derivative has the following structure:

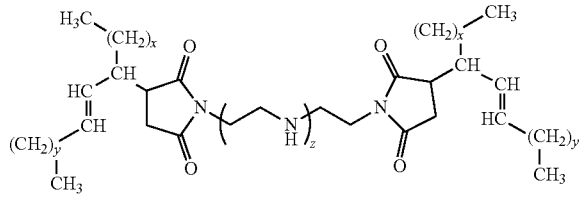

wherein x+y is from 8 to 15 and z is 0 or an integer from 1 to 5.

Embodiment 5. A booster additive package composition according to any one of the previous embodiments, wherein a second friction modifier comprises an amide friction modifier, an amine friction modifier, or a mixture or combination thereof.

Embodiment 6. A booster additive package composition according to any one of the previous embodiments, wherein the corrosion inhibitor comprises a benzotriazole.

Embodiment 7. A booster additive package composition according to any one of the previous embodiments, wherein the transmission fluid booster additive package composition comprises substantially no additional antioxidants, other than any compounds that may function as antioxidants from components (a), (b), (c), (d), and (e).

Embodiment 8. A booster additive package composition according to any one of the previous embodiments, wherein the lubricating oil basestock comprises a Group II basestock, a Group III basestock, and/or a Group V basestock and is present in a suspension-stabilizing amount from 5.0 mass % to 40 mass %, based on the weight of the booster additive package composition.

Embodiment 9. A booster additive package composition according to any one of the previous embodiments, wherein one or more of the following is satisfied: (1) a fully formulated lubricating oil composition, which comprises the booster additive package composition and a lubricating oil basestock that is the same as or different from the lubricating oil basestock in the booster additive package composition (e.g., in a mass ratio of booster additive package composition to lubricating oil basestock of from 1:49 to 1:7), is formulated to exhibit an anti-shudder durability (ASD) lifetime under constant torque of at least 85 hours; (2) the booster additive package composition contributes at least an additional 40 hours of ASD lifetime under constant torque, when added to a fresh or used fully formulated lubricating oil composition comprising, or having comprised prior to use, at least an anti-wear additive, an ashless dispersant, a detergent, a friction modifier, at least one additional antioxidant, and a lubricating oil basestock, as compared to an ASD lifetime of the fresh or used fully formulated lubricating oil composition alone (e.g., wherein a mass ratio of the booster additive package composition to fresh or used fully formulated lubricating oil composition is from 1:32 to 1:8); and (3) the booster additive package composition contributes at least a 60% increase in ASD lifetime under constant torque, when added to a fresh or used fully formulated lubricating oil composition comprising, or having comprised prior to use, at least an anti-wear additive, an ashless dispersant, a detergent, a friction modifier, at least one additional antioxidant, and a lubricating oil basestock, as compared to an ASD lifetime of the fresh or used fully formulated lubricating oil composition alone (e.g., wherein a mass ratio of the booster additive package composition to fresh or used fully formulated lubricating oil composition is from 1:32 to 1:8).

Embodiment 10. A rejuvenated, used lubricating oil composition comprising an admixture of: a major amount of a fully formulated lubricating oil composition that has been previously used to lubricate a vehicle transmission for at least 25,000 kilometers, or a lubrication running time equivalent thereto, the fully formulated lubricating oil composition having comprised, prior to use, at least an anti-wear additive, an ashless dispersant, an overbased calcium detergent, a friction modifier, a corrosion inhibitor, at least two additional antioxidants, and a lubricating oil basestock; and a minor amount of a transmission fluid booster additive package composition that maintains suspension stability when added to the previously used formulated lubricating oil composition, which booster additive package composition may be according to any of the previous embodiments or comprises: (a) a mixture comprising: (i) two or more compounds of structures (I):

(I)

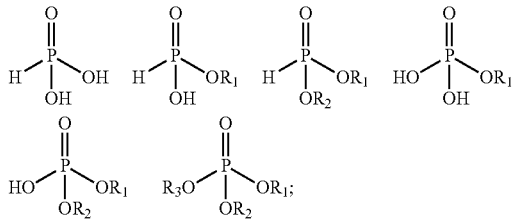

where groups $R_1$, $R_2$ and $R_3$ are independently alkyl groups having 1 to 18 carbon atoms or alkyl groups having 1 to 18 carbon atoms where the alkyl chain is interrupted by a thioether linkage, provided that, in component (i), at least some of groups $R_1$, $R_2$ and $R_3$ are alkyl groups having 1 to 18 carbon atoms where the alkyl chain is interrupted by a thioether linkage; and (ii) one or more compounds of structures (II):

$$R_4—S—R_5—O—R_7$$

$$R_4—S—R_5—O—R_6—S—R_7 \quad \text{(II)}$$

where groups $R_4$ and $R_7$ are independently alkyl groups having 1 to 12 carbon atoms and $R_5$ and $R_6$ are independently alkyl linkages having 2 to 12 carbon atoms; (b) an ashless dispersant; (c) an overbased calcium phenate detergent; (d) at least two friction modifiers, a first of which comprises a polyethylene polyamine succinimide derivative; (e) a corrosion inhibitor; and (f) a suspension-stabilizing amount of a lubricating oil basestock wherein the rejuvenated, used lubricating oil composition exhibits: a boron content from 30 to 400 parts per million by mass, based on the total mass of the rejuvenated, used lubricating oil composition; a calcium content from 250 to 800 parts per million by mass, based on the total mass of the rejuvenated, used lubricating oil composition; and a phosphorus content from 250 to 800 parts per million by mass, based on the total mass of the rejuvenated, used lubricating oil composition.

Embodiment 11. A rejuvenated composition according to embodiment 10, wherein at least 20 mass % of the transmission fluid booster additive package composition is comprised of the ashless dispersant.

Embodiment 12. A rejuvenated composition according to embodiment 10 or embodiment 11, wherein the compounds of component (i) and component (ii) are each present in the composition in an amount from 0.05 to 1.2% by mass, based on the total mass of the composition.

Embodiment 13. A rejuvenated composition according to any one of embodiments 10-12, wherein the compounds of component (i) and component (ii) are present in the composition in a mass ratio of from 2:1 to 1:2.

Embodiment 14. A rejuvenated composition according to any one of embodiments 10-13, wherein the ashless dispersant comprises a polyisobutenyl succinimide and the corrosion inhibitor comprises a benzotriazole.

Embodiment 15. A rejuvenated composition according to any one of embodiments 10-14, wherein the polyethylene polyamine succinimide derivative has the following structure:

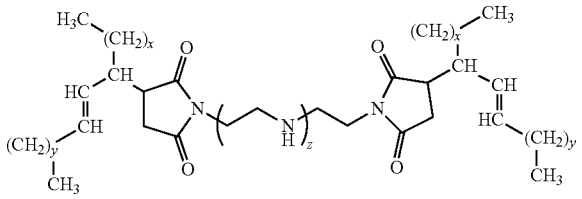

wherein x+y is from 8 to 15 and z is 0 or an integer from 1 to 5.

Embodiment 16. A rejuvenated composition according to any one of embodiments 10-15, wherein a second friction modifier comprises an amide friction modifier, an amine friction modifier, or a mixture or combination thereof.

Embodiment 17. A rejuvenated composition according to any one of embodiments 10-16, wherein the transmission fluid booster additive package composition comprises substantially no additional antioxidants, other than any compounds that may function as antioxidants from components (a), (b), (c), (d), and (e).

Embodiment 18. A rejuvenated composition according to any one of embodiments 10-17, wherein a mass ratio of the booster additive package composition to the used fully formulated lubricating oil composition is from 1:49 to 1:5.

Embodiment 19. A rejuvenated composition according to any one of embodiments 10-18, wherein the lubricating oil basestock from the booster additive package composition comprises a Group II basestock, a Group III basestock, and/or a Group V basestock, and wherein the lubricating oil basestock from the fully formulated lubricating oil composition, prior to use, comprised a Group II basestock and/or a Group III basestock.

Embodiment 20. A rejuvenated composition according to any one of embodiments 10-19, wherein one or more of the following is satisfied: (1) the rejuvenated, used lubricating oil composition exhibits an anti-shudder durability (ASD) lifetime under constant torque of at least 80 hours; (2) the rejuvenated, used lubricating oil composition exhibits an anti-shudder durability (ASD) lifetime under constant torque of an additional 40 hours, as compared to an ASD lifetime of the used fully formulated lubricating oil composition alone (e.g., wherein a mass ratio of the booster additive package composition to used fully formulated lubricating oil composition is from 1:32 to 1:8); and the rejuvenated, used lubricating oil composition contributes at least a 60% increase in ASD lifetime under constant torque, as compared to an ASD lifetime of the used fully formulated lubricating oil composition alone (e.g., wherein a mass ratio of the booster additive package composition to used fully formulated lubricating oil composition is from 1:32 to 1:8).

Embodiment 21. A rejuvenated composition according to any one of embodiments 10-20, which composition exhibits: (A) a coefficient of friction, μ, of at least 0.100 and not greater than 0.140 under LFW-1 standard test conditions at a sliding speed of about 0.125 m/s, a temperature of about 110° C., and at an applied load of about 1.1 kN (~250 lbs); (B) a coefficient of friction, (5), that is no more than 40% below and no greater than 10% above a corresponding coefficient of friction, (5), of the rejuvenated, used lubricating oil composition without the transmission fluid booster additive package composition, in which (5) is measured according to constant-torque modified JASO M349 standard anti-shudder durability test conditions; or (C) both (A) and (B).

Embodiment 22. A method of rejuvenating a fully formulated lubricating oil composition that has been previously used to lubricate a vehicle transmission for at least 25,000 kilometers, or a lubrication running time equivalent thereto, the method comprising: admixing the suspension-stable transmission fluid booster additive package composition according to any one of embodiments 1-9 with the used, fully formulated lubricating oil composition to form a rejuvenated, used lubricating oil composition, the used, fully formulated lubricating oil composition having comprised, prior to use, at least an anti-wear additive, an ashless dispersant, an overbased calcium detergent, a friction modifier, a corrosion inhibitor, at least two additional antioxidants, and a lubricating oil basestock; and lubricating the vehicle transmission to enable operation for at least an additional 30,000 kilometers, or a lubrication running time equivalent thereto.

Embodiment 23. A method of rejuvenating a fully formulated lubricating oil composition that has been previously used to lubricate a vehicle transmission for at least 25,000 kilometers, or a lubrication running time equivalent thereto, the method comprising: admixing a suspension-stable transmission fluid booster additive package composition with the used, fully formulated lubricating oil composition to form the rejuvenated, used lubricating oil composition according to any one of embodiments 10-21, the used, fully formulated lubricating oil composition having comprised, prior to use, at least an anti-wear additive, an ashless dispersant, an overbased calcium detergent, a friction modifier, a corrosion inhibitor, at least two additional antioxidants, and a lubricating oil basestock; and lubricating the vehicle transmission to enable operation for at least an additional 30,000 kilometers, or a lubrication running time equivalent thereto.

Embodiment 24. Use of the suspension-stable transmission fluid booster additive package composition according to any one of embodiments 1-9 in combination with a fresh or used fully formulated lubricating oil composition to rejuvenate lubricant properties at least partially lost during previous operation of a vehicle transmission, in particular rejuvenating one or more of anti-shudder durability, friction modification, dynamic-static friction balance, anti-wear, soot dispersion capability, detergency, suspension stability, and corrosion inhibition.

Embodiment 25. Use of the rejuvenated, used lubricating oil composition according to any one of embodiments 10-21 to rejuvenate lubricant properties at least partially lost during previous operation of a vehicle transmission, in particular rejuvenating one or more of anti-shudder durability, friction modification, dynamic-static friction balance, anti-wear, soot dispersion capability, detergency, suspension stability, and corrosion inhibition.

Examples

This invention may be further understood by reference to the following (non-limiting) examples. In the following Examples, the properties of certain components or the composition itself are described using certain terms of art, as defined below. In the Examples, all parts are parts by weight, unless otherwise noted.

"Anti-shudder durability" lifetime (or ASD life) measures the ability of a lubricating composition, e.g., when lubricating a transmission such as a CVT or other portion of a drivetrain of a vehicle, to resist erratic stick/slip friction phenomena known as "shudder." In transmissions with clutches and/or variators, for example, to prevent "shudder," the lubricant can typically provide a positive friction gradient, i.e., increasing friction coefficient with increasing sliding speed, which is often alternatively referred to as a positive dμ/dv. Negative friction gradients (or negative dμ/dv values) can result in vehicle vibrations, which have been termed "shudder." The standard method for evaluating anti-shudder (stick/slip friction) performance is JASO M349, which utilizes a low velocity friction apparatus (LVFA) to "age" the lubricant under constant-speed and constant-pressure rubbing of a steel plate against a friction plate under the conditions in Table 1.

TABLE 1

| JASO M349 Parameter | Condition |
|---|---|
| Lubricant temperature (° C.) | 120 ± 5 |
| Pressure (MPa) | 1.00 ± 0.05 |
| Sliding speed (m/s) | 0.90 ± 0.01 |
| Sliding/Rest time (mins) | 30/1 |
| μ-v measurement period (hrs) | Every 24 |

As noted in the table above, the friction-velocity (μ-v) relationship is probed every 24 hours to decide the failure point. The every-day μ-v measurement conditions are also done under constant pressure but at continuously-varying sliding speeds and under a variety of temperatures, as shown in Table 2 below.

TABLE 2

| Mu-V Testing Parameter | Condition |
|---|---|
| Lubricant temperature (° C.) | 40, 80, and 120, each ± 5 |
| Pressure (MPa) | 1.00 ± 0.05 |
| Sliding speed (m/s) | Sweep up from 0 to 1.5, then back down to 0 |
| Sliding ramp time (secs) | 3 up, 3 down |

In such a testing regimen, the ASD life is measured (usually in hours) as being when dμ/dv reaches its threshold failure value (i.e., becomes negative) at either the 0.3 m/s or the 0.9 m/s sliding speed (or, more accurately, at the point between successful and failing measurements in a least-squares curve-fit where the threshold value is reached).

However, according to the present disclosure, the anti-shudder performance testing of JASO M349 has been adapted to apply constant torque to the friction plates, instead of constant pressure. While JASO M349 (standard) ASD performance testing is run under constant-pressure, the modified JASO M349 ASD performance testing may be run under variable pressure, so that torque applied may stay approximately constant. The modified JASO M349 ASD performance testing aims to keeps applied torque constant from the start of the test throughout the test by allowing applied pressure to vary. In this case, the constant applied torque value defined is equivalent to the "initial" torque measured during JASO M349 ASD performance testing (1.00+/−0.05 MPa constant pressure). In this case, using JASO M349 (constant pressure/standard) tests performed on an Automax™ LVFA rig (using RTF-1 reference fluid and A795.D0AK friction material, with the Automax™ software being prompted to collect data points at ~10-minute intervals), the "initial" torque value can be measured either as the zero-minute data point itself or as a numerical average of the first 20 minutes of data points (i.e., the average of the 0-minute, 10-minute, and 20-minute data points), with the latter (average) torque value measurement being preferred. The other modified parameters/conditions for the constant-torque "aging" adaptation are shown in Table 3 below.

TABLE 3

| Modified JASO M349 Parameter | Condition |
|---|---|
| Lubricant temperature (° C.) | 120 ± 5 |
| Sliding speed (m/s) | 0.97 ± 0.01 |
| Sliding/Rest time (mins) | 30/1 |
| μ-v measurement period (hrs) | Every 20 |

As noted in the table above, the friction-velocity (μ-v) relationship is probed every 20 hours to decide the failure point. The every-20-hour μ-v measurement conditions are done under three different constant pressures (instead of a single constant torque) and involve a continuously-varying sweep sliding speed under a variety of temperatures, as shown in Table 4 below.

TABLE 4

| Mu-V Testing Parameter | Condition |
|---|---|
| Lubricant temperature (° C.) | 40, 80, and 120, each ± 5 |
| Pressure (MPa) | 1.00 ± 0.05 |
| Sweep sliding speed (m/s) | Sweep up from 0 to 1.4*, then back down to 0 |
| Sweep sliding ramp time (secs) | 10 up, 10 down |

*about 210 rpm.

In this latter Mu-V testing regimen, μ(5) or $\mu_5$ is the μ value at 5 rpm, μ(50) or $\mu_{50}$ is the μ value at 50 rpm, and μ(150) or $\mu_{150}$ is the μ value at 150 rpm; thus, the ratio of μ(5)/μ(50) can be a good representation of relatively low speed frictional behavior vis-à-vis shudder, and the ratio of μ(50)/μ(150) can be a good representation of relatively high speed frictional behavior vis-à-vis shudder. The anti-shudder durability (ASD) lifetime in this modified regimen is measured (also usually in hours) as being when either the ratio of μ(5)/μ(50) or the ratio of μ(50)/μ(150) reaches a threshold failure value (e.g., about 1.05) at any combination of temperature and applied pressure (or, more accurately, at the point between successful and failing measurements in a least-squares curve-fit where the threshold value is reached). The ASD lifetime values provided in the Examples below are determined based on μ(5), μ(50), and μ(150) values measured during the sweep sliding ramp procedure according to the modified/adapted conditions (see Table 4).

Fresh Lubricant Sample A, Examples 1-4, and Comparative Examples 1-4

In these Examples, a fully-formulated fresh lubricating oil composition (Fresh Lubricant Sample A) had been factory-filled into a continuously-variable transmission (CVT) of a vehicle and run for (or simulated as if it had been run for the equivalent of) at least 25,000 kilometers (e.g., ~25,000 kilometers, ~50,000 kilometers, or ~85,000 kilometers). The fully-formulated fresh lubricating oil composition (Fresh Lubricant Sample A), as first-filled, contained the following components of an additive package (suspension-stable), with the remainder of the composition comprising mostly a Group III lubricating oil basestock, optionally with a minor amount (at most 10 mass %) of Group IV lubricating oil basestock and optionally with a minor amount (at most 10 mass %) of a viscosity modifier: an anti-wear additive, an ashless dispersant, an overbased calcium detergent, at least two friction modifiers (at least one of which being an anti-shudder durability (ASD) friction modifier), a corrosion inhibitor, at least two additional antioxidants (other than the components mentioned), and a diluent (e.g., a lubricating oil basestock of appropriate viscosity). The components of the fully-formulated fresh lubricating oil composition (Fresh Lubricant Sample A), as first-filled, were sufficient to yield: a phosphorus content (i.e., as measured in accordance with ASTM D5185) of from 200 to 500 parts per million by mass (ppm), based on the mass of the fully-formulated fresh lubricating oil composition (Fresh Lubricant Sample A); a calcium content (i.e., as measured in accordance with ASTM D5185) of from 170 to 480 parts per million by mass (ppm), based on the mass of the fully-formulated fresh lubricating oil composition (Fresh Lubricant Sample A); a boron content (i.e., as measured in accordance with ASTM D5185) of from 60 to 200 parts per million by mass (ppm), based on the mass of the fully-formulated fresh lubricating oil composition (Fresh Lubricant Sample A); and a phosphorus to calcium mass ratio of from 0.85:1.0 to 1.3:1.0.

After being used, the phosphorus, calcium, and boron contents dropped to various levels, depending upon the extent and severity of use, which reductions may or may not have been uniform relative to each other (e.g., the same element ratios may or may not apply to the used lubricating oil composition(s)). After being used for (or simulating) the requisite mileage, various booster additive package compositions were added to the used lubricating oil composition(s) in the vehicle transmissions. Those booster additive package compositions are shown in Table 5 below, relative to the content of like components in the fully-formulated fresh lubricating oil composition (Fresh Lubricant Sample A).

TABLE 5

| Component | Compar. Ex. 1 | Compar. Ex. 2 | Compar. Ex. 3 | Compar. Ex. 4 | Ex. 1 | Ex. 2 | Ex. 3 | Ex. 4 |
|---|---|---|---|---|---|---|---|---|
| structure (I) cpds. | 0% | 0% | ~50% | ~50% | 0% | ~50% | ~50% | ~50% |
| structure (II) cpds. | 0% | 0% | ~50% | ~50% | 0% | ~50% | ~50% | ~50% |
| ashless dispersant | 0% | 0% | 0% | ~8% | ~50% | ~50% | ~50% | ~50% |
| Ca detergent | 0% | 0% | ~50% | ~50% | 0% | ~50% | ~50% | ~50% |
| ASD FM | ~100% | ~100% | ~100% | ~100% | ~100% | ~100% | ~100% | ~100% |
| other FM(s) | ~0% | ~100% | ~100% | ~100% | ~100% | ~100% | ~84% | ~54% |
| corrosion inhibitor | ~18% | ~18% | ~18% | ~18% | ~18% | ~18% | ~18% | ~18% |
| other antioxidant | 0% | 0% | 0% | 0% | 0% | 0% | 0% | 0% |

TABLE 5-continued

| Component | Compar. Ex. 1 | Compar. Ex. 2 | Compar. Ex. 3 | Compar. Ex. 4 | Ex. 1 | Ex. 2 | Ex. 3 | Ex. 4 |
|---|---|---|---|---|---|---|---|---|
| Elemental ppm from additives, relative to fresh formulation | | | | | | | | |
| phosphorus | 0% | 0% | ~50% | ~50% | 0% | ~50% | ~50% | ~50% |
| calcium | 0% | 0% | ~50% | ~50% | 0% | ~50% | ~50% | ~50% |
| boron | 0% | 0% | ~5% | ~53% | ~45% | ~50% | ~50% | ~50% |
| Mass ratio of booster/diluent (fresh/used lubricant oil) | | | | | | | | |
| treat rate | ~1:49 | ~1:49 | ~1:49 | ~1:49 | ~1:24 | ~1:24 | ~1:24 | ~1:24 |

Figure 7:
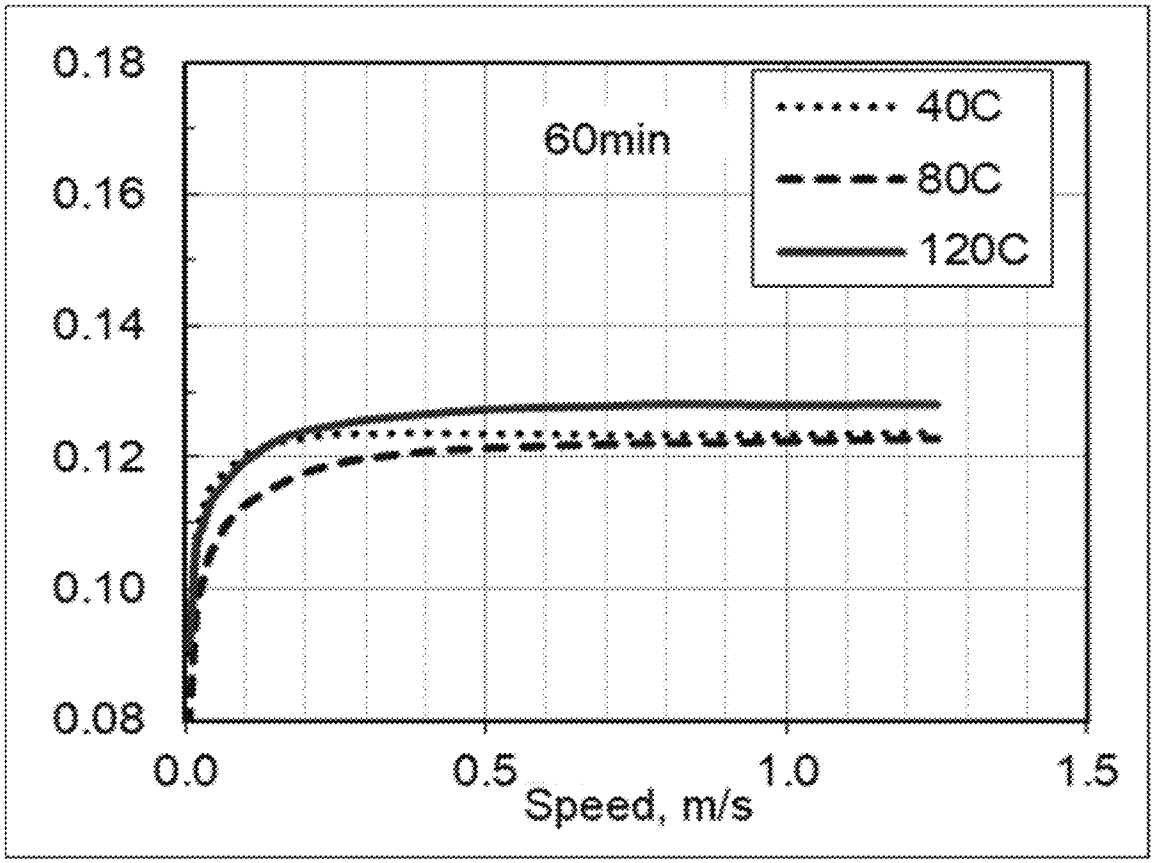
Figure 8:
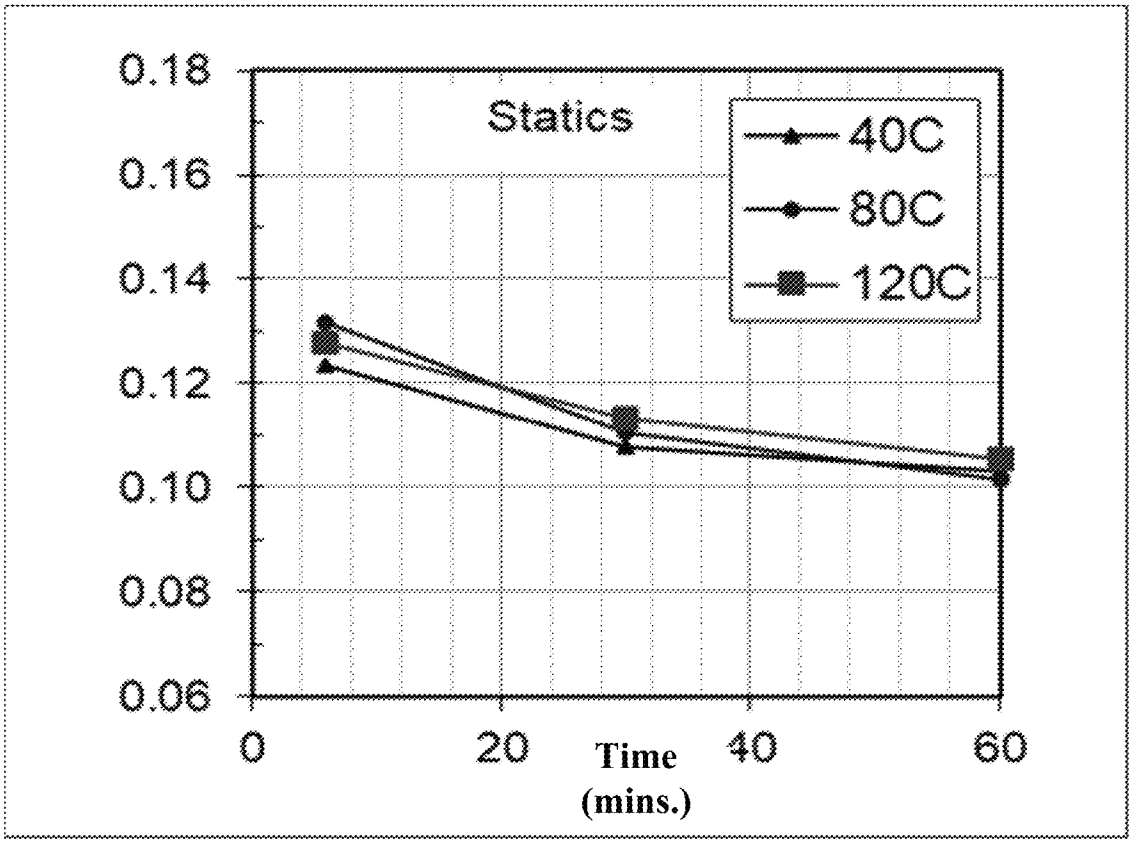
FIGS. 8-14 are graphs of static Mu characteristics (corresponding to FIGS. 1-7 and under constant pressure conditions), also at ~40° C., ~80° C., and ~120° C., for a fresh lubricating oil composition (FIG. 8) and for various rejuvenated lubricating oil compositions made from used lubricating oil composition and booster additive package compositions of Comparative Examples 1 (FIG. 9), 2 (FIG. 10), 3 (FIG. 11), and 4 (FIG. 12), and of Examples 1 (FIG. 13) and 2 (FIG. 14).
Figure 9:
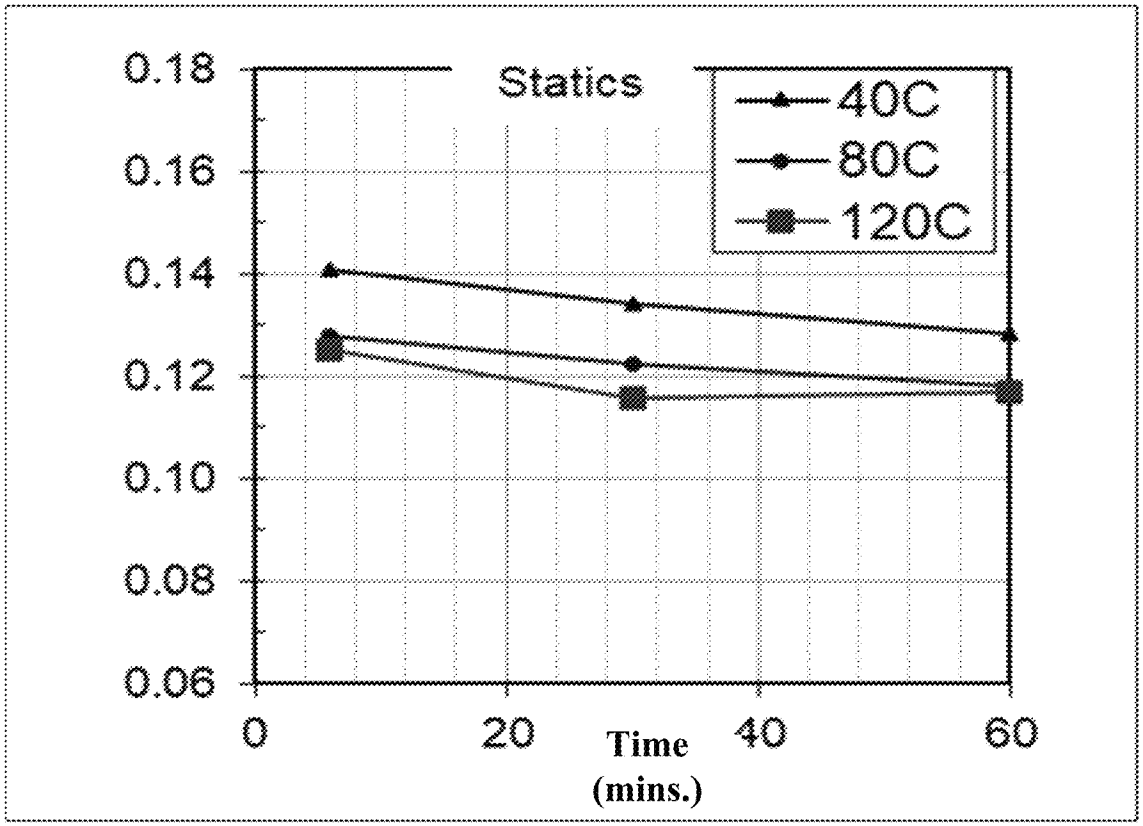
Figure 10:
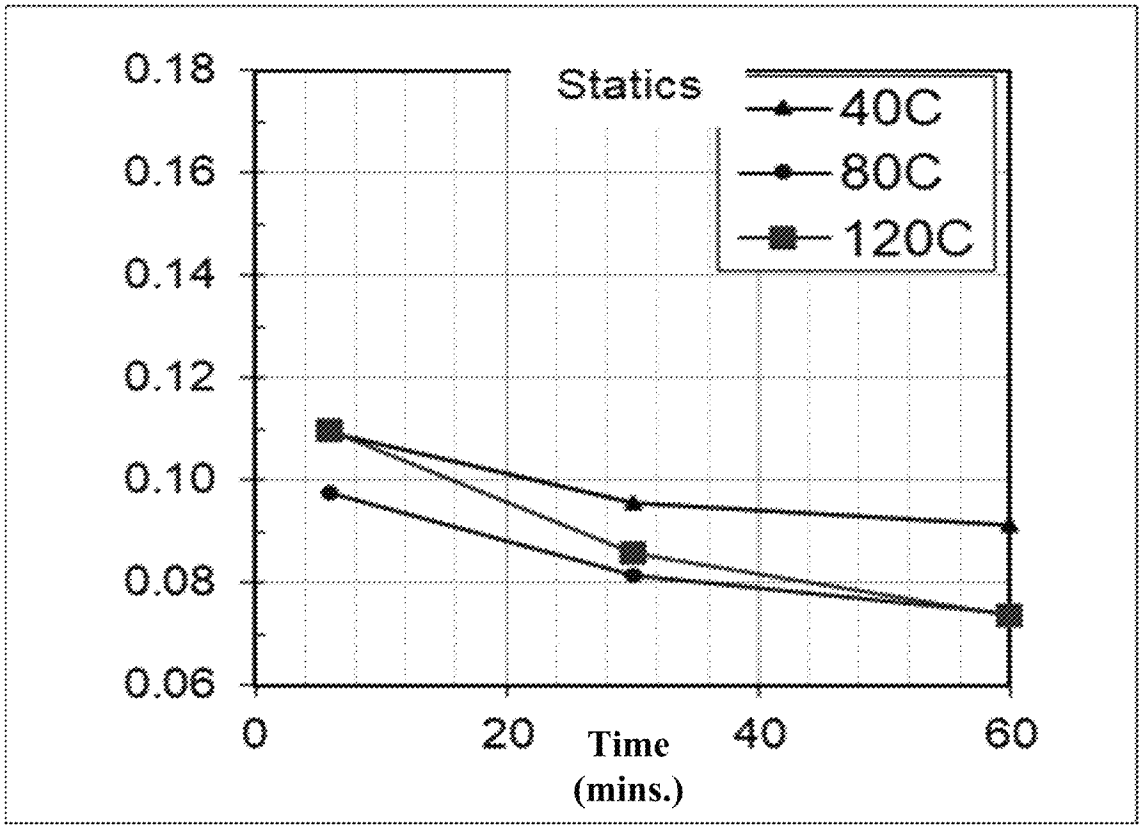
Figure 11:
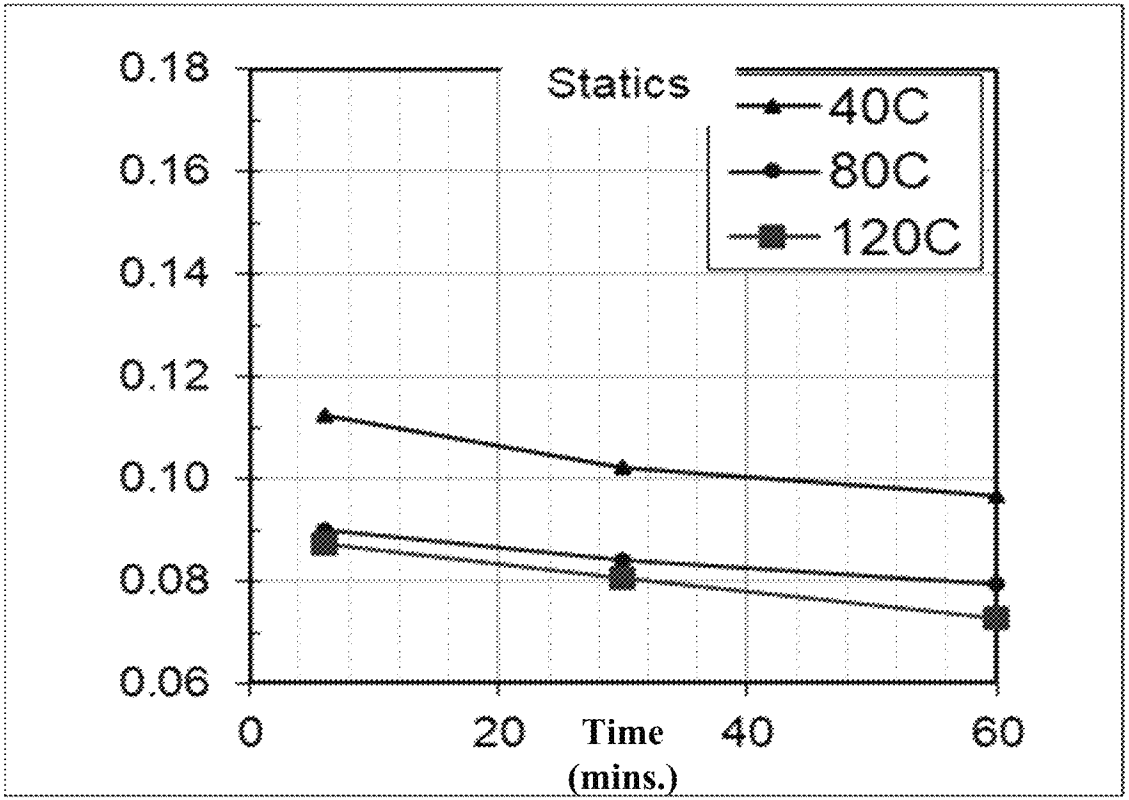
Figure 12:
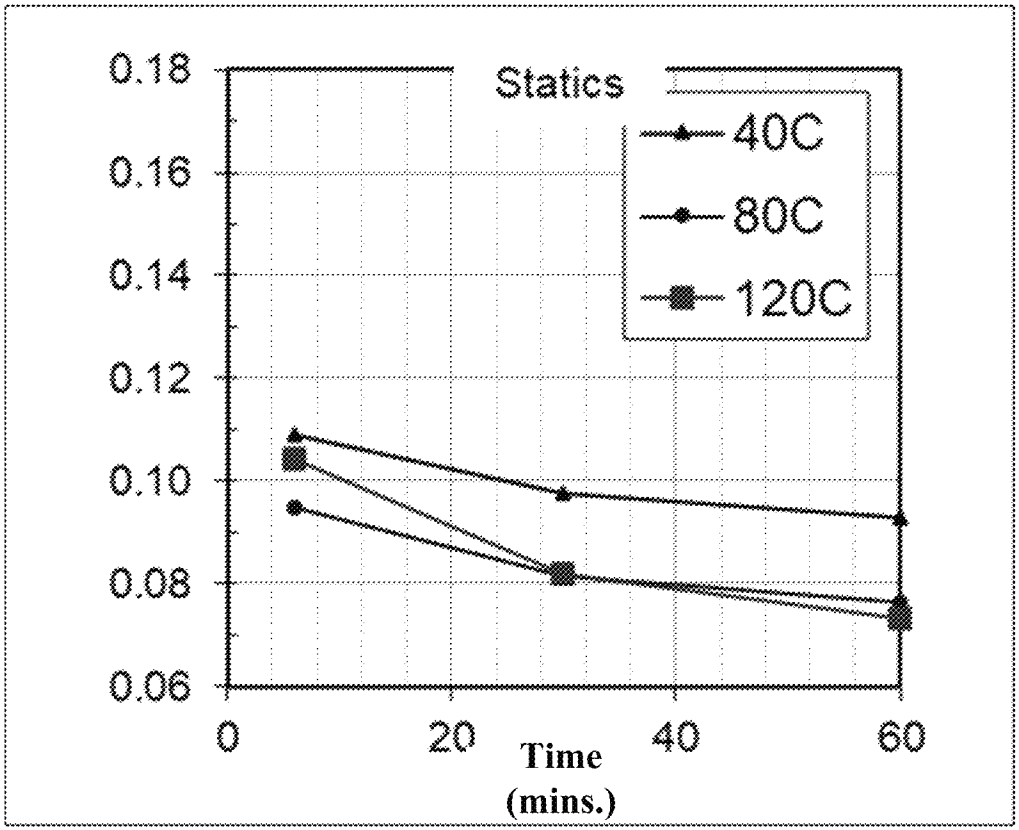
Figure 13:
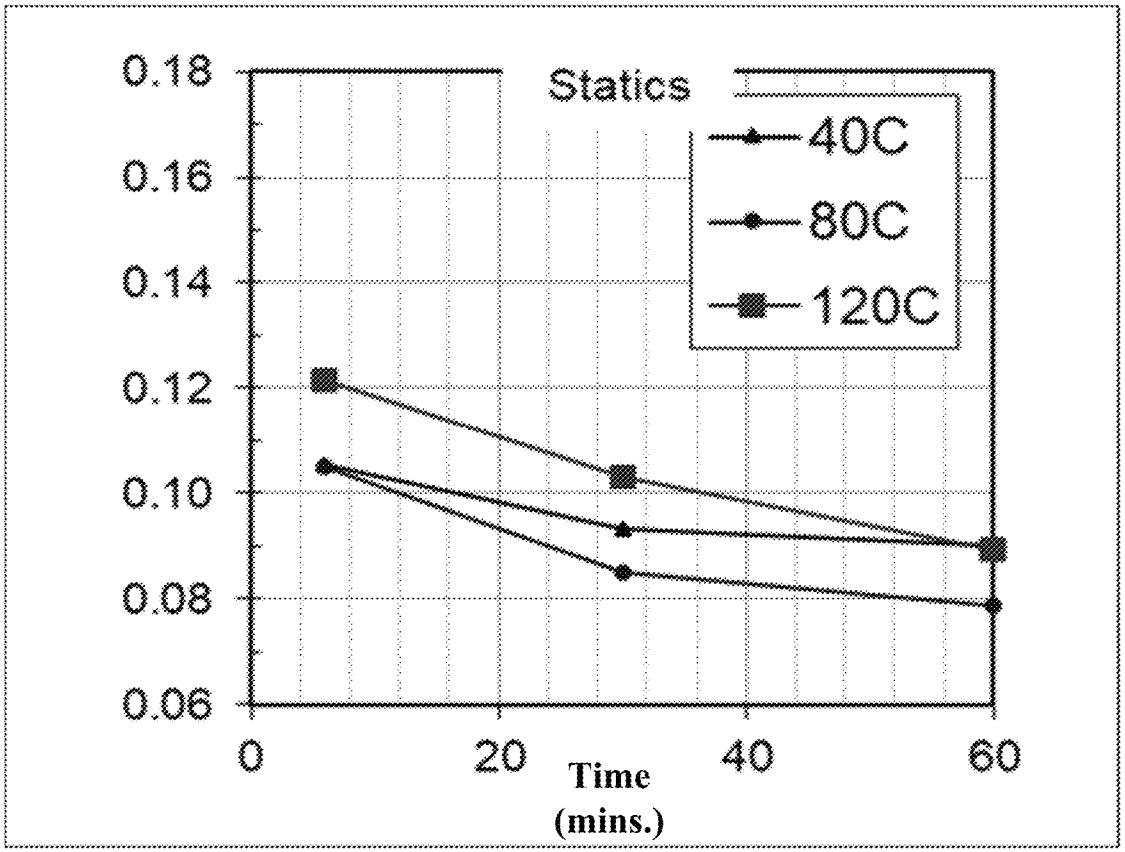
Figure 14:
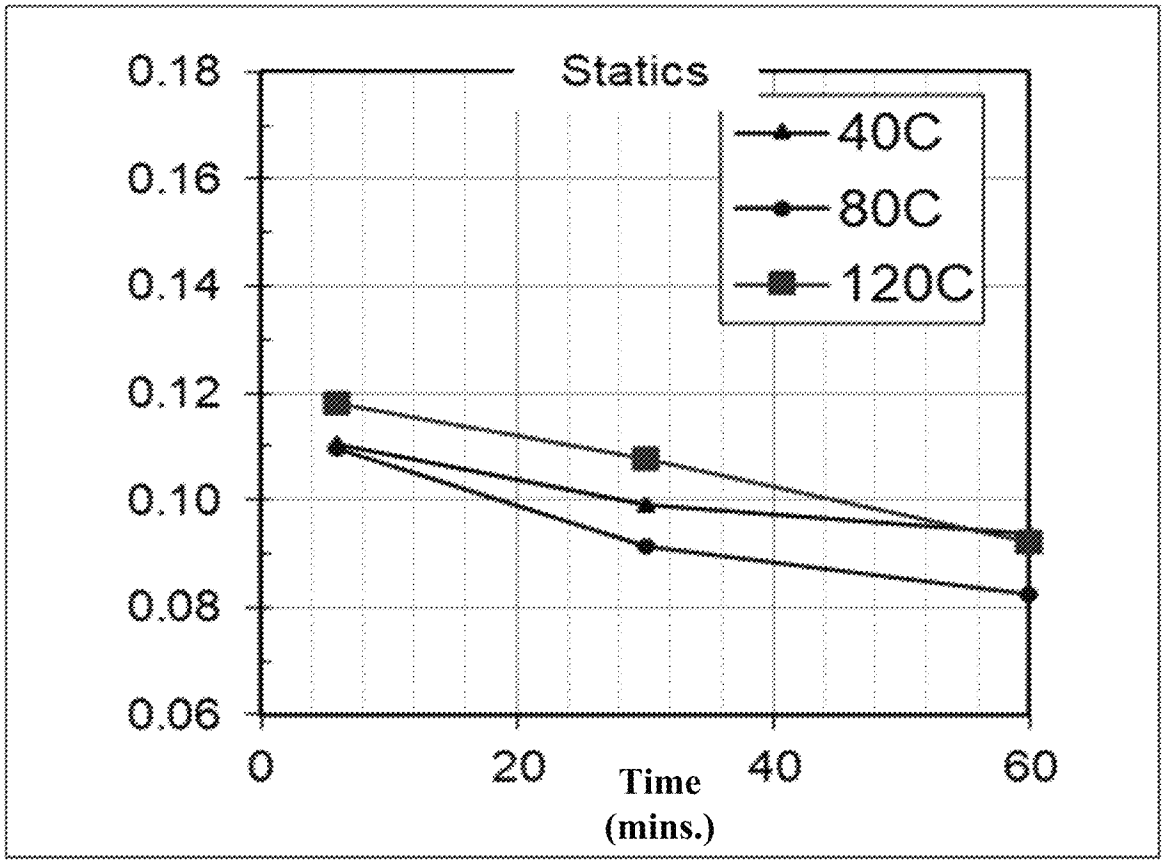

Paper-on-steel friction characteristics for these samples were measured using a small-scale Low Velocity Friction Apparatus (ssLVFA) using a Dynax™ D0535-23H fiber plate and an SAE™ 1035 tumbled steel plate. Dynamic and static friction measurements were made on these apparatus after about 6, about 30, and about 60 minutes, under ~1 MPa applied pressure and at temperatures of ~40° C., ~80° C., and ~120° C. FIGS. 1-7 show graphs of the dynamic friction characteristics for a freshly-formulated (additized) lubricating oil composition (FIG. 1) and for various rejuvenated lubricating oil compositions made from used lubricating oil composition and the booster additive package compositions of Comparative Examples 1 (FIG. 2), 2 (FIG. 3), 3 (FIG. 4), and 4 (FIG. 5), and of Examples 1 (FIG. 6) and 2 (FIG. 7). FIGS. 8-14 show the graphs of static friction characteristics, corresponding to FIGS. 1-7, for the freshly-formulated (additized) lubricating oil composition (FIG. 8) and for a rejuvenated lubricating oil composition made from used lubricating oil composition and the booster additive package compositions of Comparative Examples 1 (FIG. 9), 2 (FIG. 10), 3 (FIG. 11), and 4 (FIG. 12), and of Examples 1 (FIG. 13) and 2 (FIG. 14). Though graphs of the dynamic Mu-V curves and static coefficients of friction are not provided herein for rejuvenated lubricating oil compositions made from used lubricating oil compositions and the booster additive package compositions of Examples 3 and 4, their characteristics are believed to be similar to and consistent with those of Example 2 (FIGS. 7 and 14). This Mu-V screening process highlighted that, when combined with used, fully formulated lubricating oil compositions, the booster additive package compositions of Comparative Examples 1-4 did not exhibit sufficiently "rejuvenated" dynamic friction characteristics, compared to the fresh version of the fully formulated lubricating oil compositions, whereas the booster additive package compositions of Examples 1-2 did.

Figure 15:
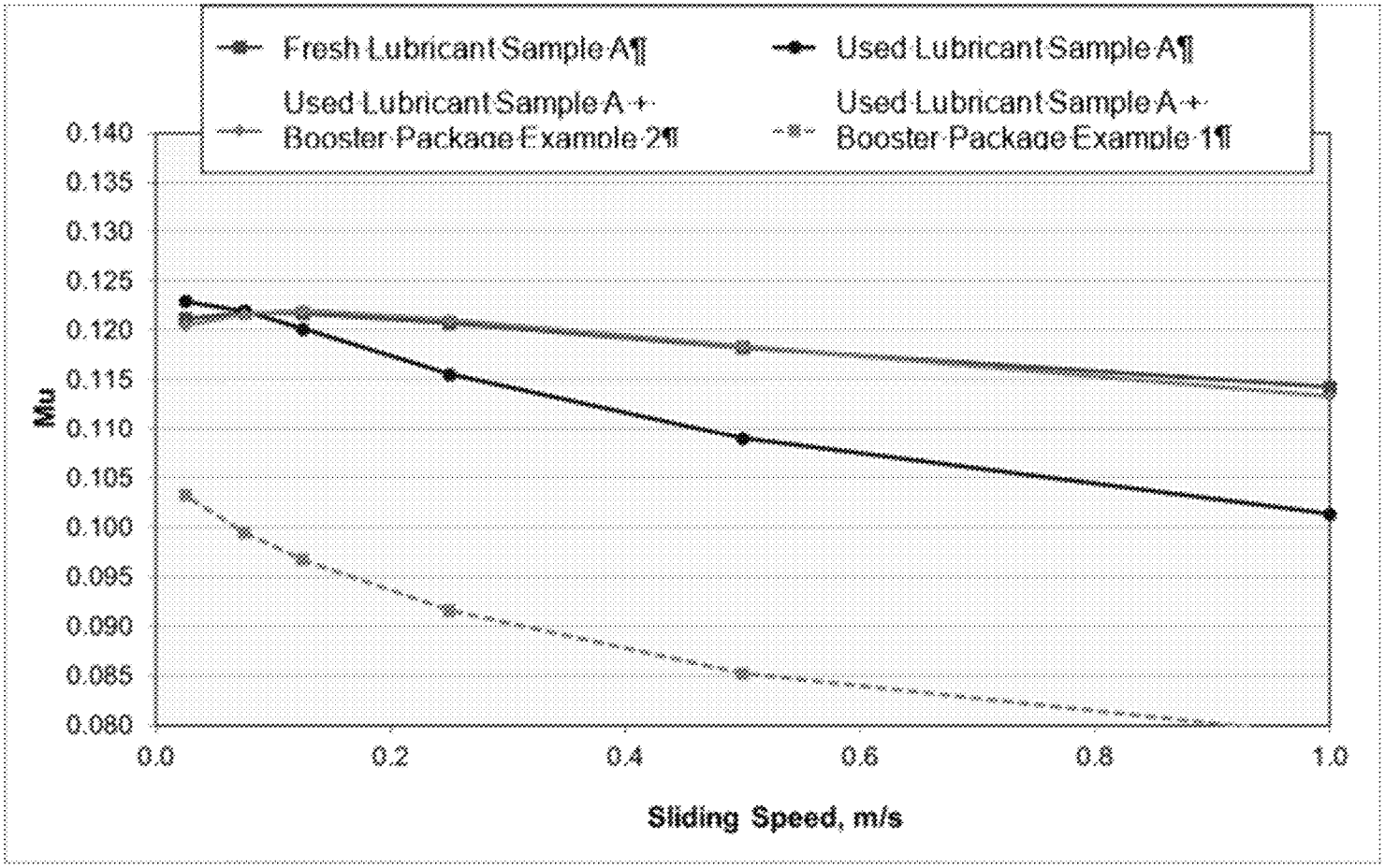
FIG. 15 is a graph of metal-on-metal (steel-on-steel) frictional characteristics involving a fresh lubricating oil composition, a used lubricating oil composition, and a combination of Example 1 and 2 booster package compositions with the used lubricating oil composition.

Furthermore, FIG. 15 shows that the rejuvenated used lubricating oil composition comprising the booster additive package composition of Example 1 (with substantially no additional phosphorus-containing anti-wear component and with substantially no additional detergent component) exhibited metal-on-metal friction characteristics that would be too low for CVT transmissions in which metal-on-metal (e.g., steel-on-steel) friction characteristics should be adequately high (e.g., a coefficient of friction, μ, of at least 0.110, and optionally not greater than 0.140, under LFW-1 standard test conditions at a sliding speed of about 0.125 m/s, a temperature of about 110° C., and at an applied load of about 1.1 kN (~250 lbs)). LFW-1 standard test conditions are well known to the ordinary skilled artisan, and similar testing conditions are disclosed in the JASO M358 (2005) standard test method. Under such conditions/testing, the rejuvenated used lubricating oil composition comprising the booster additive package composition of Example 1 exhibited a less than 0.100, whereas the rejuvenated used lubricating oil composition comprising the booster additive package composition of Example 2, as well as the used lubricating oil composition itself (without any booster package) and the fresh (fully formulated) lubricating oil composition, exhibited values of ~0.122, ~0.120, and ~0.122, respectively. Thus, while the booster additive package composition of Example 1 may be useful in extending ASD lifetime in transmission/drivetrain setups without significant metal-on-metal friction (e.g., non-CVT drivetrains, such as wet clutch, dual clutch, manual, automatic, and the like), its low metal-on-metal friction coefficient can render it relatively undesirable in CVT applications.

Fresh Lubricant Samples A-B, Used Lubricant Samples C-F, and Examples 3-12

In these Examples, the booster additive package compositions of Examples 3-12 were combined with ("diluted" by) either a fully-formulated fresh lubricating oil composition (Fresh Lubricant Sample A or B) or a lubricating oil composition (Used Lubricant Sample C, D, E, or F) that had been used by being run in a continuously-variable transmission (CVT) of a vehicle for at least 25,000 kilometers (Used Lubricant Samples C, D, E, and F were collected from, respectively: a mid-size vehicle with a 4-cylinder transmission that had been run for ~51,000 kilometers; a mid-size vehicle with a 4-cylinder transmission that had been run for ~25,000 kilometers; a dyno unit test on a 4-cylinder transmission that had been simulated run for ~50,000 kilometers; and a small SUV vehicle with a V6 transmission that had been run for ~85,000 kilometers). Before being used (i.e., when factory-filled into their respective vehicles), the "diluent" (fresh or used) lubricating oil compositions contained the following components of an additive package (suspension-stable), with the remainder of the composition comprising mostly a Group III lubricating oil basestock, optionally with a minor amount of Group IV lubricating oil basestock and optionally with a minor amount of a viscosity modifier: an anti-wear additive, an ashless dispersant, an overbased calcium detergent, at least two friction modifiers (at least one of which being an anti-shudder durability (ASD) friction modifier), a corrosion inhibitor, at least two additional antioxidants (other than the components mentioned), and a diluent (e.g., a lubricating oil basestock of appropriate viscosity). The components of each of the used lubricating oil compositions (Used Lubricant Sample C, D, E, or F), after their respective use levels, obviously exhibited differing contents of phosphorus, calcium, and boron (i.e., each as measured in accordance with ASTM D5185), depending upon the extent and severity of use (e.g., level of degradation) and/or other cause that would result in reduction of such elemental content levels in the used lubricating oil compositions. Table 6 below describes the P, Ca, and B contents of the various used lubricant samples, as well as a baseline level of their anti-shudder durability (ASD) lifetimes, measured as-used by themselves, with no booster package added, according to the modified JASO M349 test method under constant torque conditions using a Dynax™ D0535-23H fiber plate, as described hereinabove. For reference, a typical ASD lifetime range for a fresh fully-formulated CVT lubricant oil composition (e.g., Fresh Lubricant Sample A or B) can be from about 65 to about 80 hours—indeed, though not enumerated in Table 6, the ASD lifetimes (according to the constant torque method) of Fresh Lubricant Sample A and Fresh Lubricant Sample B were measured to be 65 hours and 75 hours, respectively.

TABLE 6

| Elemental ppm by mass | Used Sample C | Used Sample D | Used Sample E | Used Sample F |
|---|---|---|---|---|
| phosphorus | 233 | 294 | 275 | 219 |
| calcium | 239 | 283 | 262 | 202 |

TABLE 6-continued

| Elemental ppm by mass | Used Sample C | Used Sample D | Used Sample E | Used Sample F |
|---|---|---|---|---|
| boron | 36 | 116 | 93 | 84 |
| ASD lifetime (constant torque method) [hours] | 37 | 52 | 6 | 2 |

After being used for the requisite mileage, booster additive package compositions of Examples 3-12 were added to a fresh or a used lubricating oil composition (Fresh Lubricant Sample A or B, or Used Lubricant Sample C, D, E, or F). The booster additive package compositions of Examples 3-14 are shown in Tables 7-8 below, relative to the content of like components in the respective fresh and/or used lubricating oil compositions.

TABLE 7

| Component | Ex. 3 | Ex. 4 | Ex. 5 | Ex. 6 | Ex. 7 | Ex. 8 |
|---|---|---|---|---|---|---|
| structure (I) compounds | ~50% | ~50% | ~100% | ~100% | ~50% | ~100% |
| structure (II) compounds | ~50% | ~50% | ~100% | ~100% | ~50% | ~100% |
| ashless dispersant | ~50% | ~50% | ~100% | ~100% | ~100% | ~50% |
| Ca detergent | ~50% | ~50% | ~100% | ~100% | ~50% | ~50% |
| ASD FM | ~100% | ~100% | ~200% | ~200% | ~100% | ~100% |
| other FM(s) | ~84% | ~54% | ~168% | ~109% | ~84% | ~84% |
| corrosion inhibitor | ~18% | ~18% | ~36% | ~36% | ~18% | ~18% |
| other antioxidant | 0% | 0% | 0% | 0% | 0% | 0% |
| Elemental ppm from additives, relative to fresh formulation | | | | | | |
| phosphorus | ~50% | ~50% | ~100% | ~100% | ~50% | ~100% |
| calcium | ~50% | ~50% | ~100% | ~100% | ~50% | ~50% |
| boron | ~50% | ~50% | ~100% | ~100% | ~95% | ~55% |
| Mass ratio of booster/diluent (fresh/used lubricant oil) | | | | | | |
| treat rate | ~1:24 | ~1:24 | ~1:11.5 | ~1:11.5 | ~1:19 | ~1:19 |

TABLE 8

| Component | Ex. 9 | Ex. 10 | Ex. 11 | Ex. 12 | Ex. 13 | Ex. 14 |
|---|---|---|---|---|---|---|
| structure (I) compounds | ~50% | ~100% | ~100% | ~50% | ~50% | ~50% |
| structure (II) compounds | ~50% | ~100% | ~100% | ~50% | ~50% | ~50% |
| ashless dispersant | ~50% | ~50% | ~100% | ~100% | ~50% | ~50% |
| Ca detergent | ~100% | ~100% | ~50% | ~100% | ~50% | ~50% |
| ASD FM | ~100% | ~100% | ~100% | ~100% | ~175% | ~100% |
| other FM(s) | ~84% | ~84% | ~84% | ~84% | ~84% | ~84% |
| corrosion inhibitor | ~18% | ~18% | ~18% | ~18% | ~28% | ~18% |
| other antioxidant | 0% | 0% | 0% | 0% | 0% | ~40% |
| Elemental ppm from additives, relative to fresh formulation | | | | | | |
| phosphorus | ~50% | ~100% | ~100% | ~50% | ~50% | ~50% |
| calcium | ~100% | ~100% | ~50% | ~100% | ~50% | ~50% |
| boron | ~50% | ~55% | ~100% | ~95% | ~50% | ~50% |
| Mass ratio of booster/diluent (fresh/used lubricant oil) | | | | | | |
| treat rate | ~1:19 | ~1:19 | ~1:15.7 | ~1:15.7 | ~1:24 | ~1:24 |

A combinatorial matrix of experiments for establishing ASD lifetime and ASD lifetime increase (in both hours and percent increase above the "Diluent" ASD lifetime) for combinations of booster packages according to the present disclosure and either fresh or used lubricating oil compositions described herein is shown in Table 9 below. In addition, though graphics are not shown, each of the combinations of booster package and lubricant sample (diluent) from Table 8 above were tested during the ASD lifetime measurements and were found to have a μ(5) that was no more than 400 below (and optionally no more than 1% above) the μ(5) for the used lubricant samples and that was no more than 300 below (and optionally no more than 10% above) the μ(5) for the fresh lubricant samples.

TABLE 9

| Booster Package (X) | "Diluent" (Y) | Treat rate (X:Y) | ASD lifetime [hrs] | ASD lifetime increase [hrs] (% abv Diluent) |
|---|---|---|---|---|
| Example 3 | Fresh Lubricant A | ~1:24 | 123 | 48 (63%) |
| Example 4 | Fresh Lubricant B | ~1:24 | 129 | 64 (98%) |
| Example 5 | Fresh Lubricant A | ~1:11.5 | 162 | 87 (116%) |
| Example 7 | Fresh Lubricant A | ~1:19 | 124 | 49 (66%) |
| Example 8 | Fresh Lubricant A | ~1:19 | 155 | 80 (107%) |
| Example 9 | Fresh Lubricant A | ~1:19 | 158 | 83 (110%) |
| Example 12 | Fresh Lubricant A | ~1:15.7 | 196 | 121 (161%) |
| Example 13 | Fresh Lubricant A | ~1:24 | 140 | 65 (87%) |
| Example 14 | Fresh Lubricant A | ~1:24 | 115 | 40 (53%) |
| Example 3 | Used Lubricant C | ~1:24 | 85 | 48 (130%) |
| Example 4 | Used Lubricant C | ~1:24 | 79 | 42 (114%) |
| Example 5 | Used Lubricant C | ~1:11.5 | 135 | 98 (265%) |
| Example 4 | Used Lubricant D | ~1:24 | 93 | 41 (78%) |
| Example 4 | Used Lubricant E | ~1:24 | 47 | 41 (685%) |
| Example 6 | Used Lubricant E | ~1:11.5 | 102 | 96 (1600%) |
| Example 4 | Used Lubricant F | ~1:24 | 38 | 36 (1810%) |
| Example 6 | Used Lubricant F | ~1:11.5 | 85 | 83 (4160%) |

In order to ensure that a rejuvenated lubricating oil composition satisfies the various different friction performances in transmission/drivetrain systems, dynamic friction characteristics of the rejuvenated lubricating oil compositions can advantageously be controlled to be superior or comparable to (e.g., within reasonable variation from) those of the "used" lubricating oil compositions, before the booster additive package is introduced, and perhaps even ideally returned at or near the fresh version of the fully formulated lubricating oil composition before use. These dynamic frictional properties can be indicative of drivetrain performance during steady state operational conditions, and, generally, a negative slope in the dynamic Mu-V profile is desirable. However, in addition, static friction and/or relatively low-speed dynamic (near-static) friction levels may also be controlled to be superior or comparable to those of the "used" lubricating oil compositions, before the booster additive package is introduced, and perhaps even ideally returned at or near the fresh version of the fully formulated lubricating oil composition before use. These static and/or near-static frictional properties can be indicative of torque capacity of the (typically non-metal, e.g., paper) clutch system. If the static/near-static friction is too high, significant wear can occur; if too low, the "stick" portion of the stick-slip friction that causes the clutch to engage with other transmission/drivetrain components can be insufficient to transfer the torque, also resulting in inferior operation. There are intimate correlations between low-speed dynamic friction and static friction in that high static friction generally coincides with high low-speed dynamic friction and affects the slope of the Mu-V curve (e.g., ideally retaining it as negative). Therefore, a particularly advantageous goal of lubricant oil composition rejuvenation is to control low-speed dynamic friction and static friction to both be within an operational window, while simultaneously controlling dynamic friction behavior to yield a negative (or approximately zero) slope.

The disclosures of all patents, articles and other materials described herein are hereby incorporated, in their entirety, into this specification by reference. A description of a composition comprising, consisting of, or consisting essentially of multiple specified components, as presented herein and in the appended claims, should be construed to also encompass compositions made by admixing said multiple specified components. The principles, preferred embodiments and modes of operation of the present invention have been described in the foregoing specification. What applicants submit is their invention, however, is not to be construed as limited to the particular embodiments disclosed, since the disclosed embodiments are regarded as illustrative rather than limiting. Changes may be made by those skilled in the art without departing from the spirit of the invention.

The invention claimed is:

1. A suspension-stable transmission fluid booster additive package composition comprising:

(a) anti-wear compounds consisting of a mixture comprising:

(i) two or more compounds of structures (I):

(I)

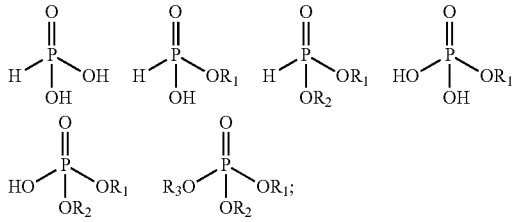

where groups $R_1$, $R_2$ and $R_3$ are independently alkyl groups having 1 to 18 carbon atoms or alkyl groups having 1 to 18 carbon atoms where the alkyl chain is interrupted by a thioether linkage, provided that, in component (i), at least one incarnation represented by at least one moiety from the mixture comprising structure (I) as functionalized in a set of all groups $R_1$, $R_2$ and $R_3$ in all structure (I) compounds, collectively, are alkyl groups having 1 to 18 carbon atoms where the alkyl chain is interrupted by a thioether linkage; and (ii) one or more compounds of structures (II):

$$R_4—S—R_5—O—R_7$$

$$R_4—S—R_5—O—R_6—S—R_7 \quad \text{(II)}$$

where groups $R_4$ and $R_7$ are independently alkyl groups having 1 to 12 carbon atoms and $R_5$ and $R_6$ are independently alkyl linkages having 2 to 12 carbon atoms;

(b) an ashless dispersant representing at least 20 mass % of the transmission fluid booster additive package composition;

(c) an overbased calcium phenate detergent;

(d) at least two friction modifiers, a first of which comprises a polyethylene polyamine succinimide derivative, and a second friction modifier comprises an amide friction modifier, an amine friction modifier, or a mixture or combination thereof;

(e) a corrosion inhibitor; and (f) a suspension-stabilizing amount of a lubricating oil basestock, wherein the transmission fluid booster additive package composition exhibits:

a boron content from 0.04 mass % to 0.75 mass %, based on the total mass of the additive package composition;

a calcium content from 0.3 mass % to 1.5 mass %, based on the total mass of the additive package composition; and a phosphorus content from 0.3 mass % to 1.5 mass %, based on the total mass of the additive package composition.

2. A booster additive package composition according to claim 1, wherein the compounds of component (i) and component (ii) are present in the composition in a mass ratio of from 2:1 to 1:2.

3. A booster additive package composition according to claim 1, wherein the ashless dispersant comprises a polyisobutenyl succinimide.

4. A booster additive package composition according to claim 1, wherein the polyethylene polyamine succinimide derivative has the following structure:

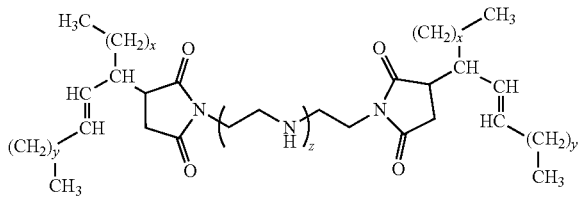

wherein x+y is from 8 to 15 and z is 0 or an integer from 1 to 5.

5. A booster additive package composition according to claim 1, wherein the corrosion inhibitor comprises a benzotriazole.

6. A booster additive package composition according to claim 1, wherein the transmission fluid booster additive package composition comprises substantially no additional antioxidants, other than any compounds that may function as antioxidants from components (a), (b), (c), (d), and (e).

7. A booster additive package composition according to claim 1, wherein the lubricating oil basestock comprises a Group II basestock, a Group III basestock, and/or a Group V basestock and is present in a suspension-stabilizing amount from 5.0 mass % to 40 mass %, based on the weight of the booster additive package composition.

8. A booster additive package composition according to claim 1, wherein a fully formulated lubricating oil composition, which comprises the booster additive package composition and a lubricating oil basestock that is the same as or different from the lubricating oil basestock in the booster additive package composition in a mass ratio of booster additive package composition to lubricating oil basestock of from 1:49 to 1:7, is formulated to exhibit an anti-shudder durability (ASD) lifetime under constant torque of at least 85 hours.

9. A booster additive package composition according to claim 1, which contributes at least an additional 40 hours of ASD lifetime under constant torque, when added to a fresh or used fully formulated lubricating oil composition comprising, or having comprised prior to use, at least an anti-wear additive, an ashless dispersant, a detergent, a friction modifier, at least one additional antioxidant, and a lubricating oil basestock, as compared to an ASD lifetime of the fresh or used fully formulated lubricating oil composition alone, wherein a mass ratio of the booster additive package composition to fresh or used fully formulated lubricating oil composition is from 1:32 to 1:8.

10. A booster additive package composition according to claim 1, which contributes at least a 60% increase in ASD lifetime under constant torque, when added to a fresh or used fully formulated lubricating oil composition comprising, or having comprised prior to use, at least an anti-wear additive, an ashless dispersant, a detergent, a friction modifier, at least one additional antioxidant, and a lubricating oil basestock, as compared to an ASD lifetime of the fresh or used fully formulated lubricating oil composition alone, wherein a mass ratio of the booster additive package composition to fresh or used fully formulated lubricating oil composition is from 1:32 to 1:8.

11. A rejuvenated, used lubricating oil composition comprising an admixture of:

a major amount of a fully formulated lubricating oil composition that has been previously used to lubricate a vehicle transmission for at least 25,000 kilometers, or a lubrication running time equivalent thereto, the fully formulated lubricating oil composition having comprised, prior to use, at least an anti-wear additive, an ashless dispersant, an overbased calcium detergent, a friction modifier, a corrosion inhibitor, at least two additional antioxidants, and a lubricating oil basestock; and a minor amount of a suspension-stable transmission fluid booster additive package composition that maintains suspension stability when added to the previously used formulated lubricating oil composition, which booster additive package composition comprises:

(a) anti-wear compounds consisting essentially of a mixture comprising:

(i) two or more compounds of structures (I):

(I)

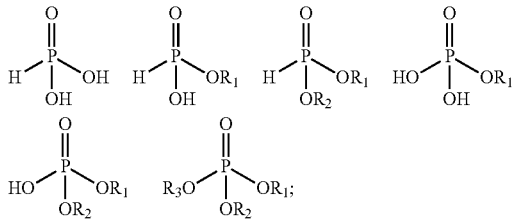

where groups $R_1$, $R_2$ and $R_3$ are independently alkyl groups having 1 to 18 carbon atoms or alkyl groups having 1 to 18 carbon atoms where the alkyl chain is interrupted by a thioether linkage, provided that, in component (i), at least one incarnation represented by at least one moiety from the mixture comprising structure (I) as functionalized in a set of all groups $R_1$, $R_2$ and $R_3$ in all structure (I) compounds, collectively, are alkyl groups having 1 to 18 carbon atoms where the alkyl chain is interrupted by a thioether linkage; and (ii) one or more compounds of structures (II):

$$R_4—S—R_5—O—R_7$$

$$R_4—S—R_5—O—R_6—S—R_7 \quad \text{(II)}$$

where groups $R_4$ and $R_7$ are independently alkyl groups having 1 to 12 carbon atoms and $R_5$ and $R_6$ are independently alkyl linkages having 2 to 12 carbon atoms;

(b) an ashless dispersant;

(c) an overbased calcium phenate detergent;

(d) at least two friction modifiers, a first of which comprises a polyethylene polyamine succinimide derivative, and a second friction modifier comprises an amide friction modifier, an amine friction modifier, or a mixture or combination thereof;

(e) a corrosion inhibitor; and (f) a suspension-stabilizing amount of a lubricating oil basestock, wherein the rejuvenated, used lubricating oil composition exhibits:

a boron content from 30 to 400 parts per million by mass, based on the total mass of the rejuvenated, used lubricating oil composition;

a calcium content from 250 to 800 parts per million by mass, based on the total mass of the rejuvenated, used lubricating oil composition; and a phosphorus content from 250 to 800 parts per million by mass, based on the total mass of the rejuvenated, used lubricating oil composition.

12. A rejuvenated composition according to claim 11, wherein at least 20 mass % of the transmission fluid booster additive package composition is comprised of the ashless dispersant.

13. A rejuvenated composition according to claim 11, wherein the compounds of component (i) and component (ii) are each present in the composition in an amount from 0.05 to 1.2% by mass, based on the total mass of the composition.

14. A rejuvenated composition according to claim 11, wherein the compounds of component (i) and component (ii) are present in the composition in a mass ratio of from 2:1 to 1:2.

15. A rejuvenated composition according to claim 11, wherein the ashless dispersant comprises a polyisobutenyl succinimide and the corrosion inhibitor comprises a benzotriazole.

16. A rejuvenated composition according to claim 11, wherein the polyethylene polyamine succinimide derivative has the following structure:

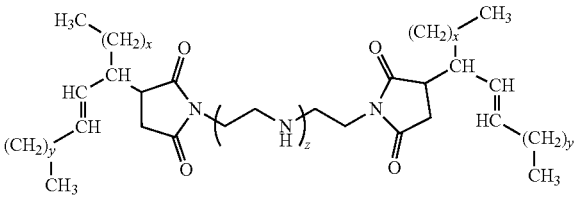

wherein x+y is from 8 to 15 and z is 0 or an integer from 1 to 5.

17. A rejuvenated composition according to claim 11, wherein the transmission fluid booster additive package composition comprises substantially no additional antioxidants, other than any compounds that may function as antioxidants from components (a), (b), (c), (d), and (e).

18. A rejuvenated composition according to claim 11, wherein a mass ratio of the booster additive package composition to the used fully formulated lubricating oil composition is from 1:49 to 1:7.

19. A rejuvenated composition according to claim 11, wherein the lubricating oil basestock from the booster additive package composition comprises a Group II basestock, a Group III basestock, and/or a Group V basestock, and wherein the lubricating oil basestock from the fully formulated lubricating oil composition, prior to use, comprised a Group II basestock and/or a Group III basestock.

20. A rejuvenated composition according to claim 11, wherein the rejuvenated, used lubricating oil composition exhibits an anti-shudder durability (ASD) lifetime under constant torque of at least 80 hours.

21. A rejuvenated composition according to claim 11, wherein the rejuvenated, used lubricating oil composition exhibits an anti-shudder durability (ASD) lifetime under constant torque of an additional 40 hours, as compared to an ASD lifetime of the used fully formulated lubricating oil composition alone, wherein a mass ratio of the booster additive package composition to used fully formulated lubricating oil composition is from 1:32 to 1:8.

22. A rejuvenated composition according to claim 11, wherein the rejuvenated, used lubricating oil composition contributes at least a 60% increase in ASD lifetime under constant torque, as compared to an ASD lifetime of the used fully formulated lubricating oil composition alone, wherein a mass ratio of the booster additive package composition to used fully formulated lubricating oil composition is from 1:32 to 1:8.

23. A rejuvenated composition according to claim 11, which composition exhibits:

(A) a coefficient of friction, μ, of at least 0.100 and not greater than 0.140 under LFW-1 standard test conditions at a sliding speed of about 0.125 m/s, a temperature of about 110° C., and at an applied load of about 1.1 kN (~250 lbs);

(B) a coefficient of friction, μ(5), that is no more than 40% below and no greater than 10% above a corresponding coefficient of friction, μ(5), of the rejuvenated, used lubricating oil composition without the transmission fluid booster additive package composition, in which μ(5) is measured according to constant-torque modified JASO M349 standard anti-shudder durability test conditions; or (C) both (A) and (B).

24. A method of rejuvenating a fully formulated lubricating oil composition that has been previously used to lubricate a vehicle transmission for at least 25,000 kilometers, or a lubrication running time equivalent thereto, the method comprising:

admixing the suspension-stable transmission fluid booster additive package composition according to claim 1 with the used, fully formulated lubricating oil composition to form a rejuvenated, used lubricating oil composition, the used, fully formulated lubricating oil composition having comprised, prior to use, at least an anti-wear additive, an ashless dispersant, an overbased calcium detergent, a friction modifier, a corrosion inhibitor, at least two additional antioxidants, and a lubricating oil basestock; and lubricating the vehicle transmission to enable operation for at least an additional 30,000 kilometers, or a lubrication running time equivalent thereto.

25. A method of rejuvenating a fully formulated lubricating oil composition that has been previously used to lubricate a vehicle transmission for at least 25,000 kilometers, or a lubrication running time equivalent thereto, the method comprising:

admixing a suspension-stable transmission fluid booster additive package composition with the used, fully formulated lubricating oil composition to form the rejuvenated, used lubricating oil composition according to claim 11, the used, fully formulated lubricating oil composition having comprised, prior to use, at least an anti-wear additive, an ashless dispersant, an overbased calcium detergent, a friction modifier, a corrosion inhibitor, at least two additional antioxidants, and a lubricating oil basestock; and lubricating the vehicle transmission to enable operation for at least an additional 30,000 kilometers, or a lubrication running time equivalent thereto.

* * * * *